US005429916A

United States Patent [19]

Ohshima

[11] Patent Number: 5,429,916

[45] Date of Patent: Jul. 4, 1995

[54] SILVER HALIDE COLOR PHOTOGRAPHIC PHOTOSENSITIVE MATERIAL AND METHOD OF FORMING COLOR IMAGES

[75] Inventor: Naoto Ohshima, Kanagawa, Japan

[73] Assignee: Fuji Photo Film Co., Ltd., Kanagawa, Japan

[21] Appl. No.: 253,135

[22] Filed: Jun. 2, 1994

[30] Foreign Application Priority Data

Jun. 2, 1993 [JP] Japan ..... 5-156174

[51] Int. Cl.[6] ..... G03C 1/775

[52] U.S. Cl. ..... 430/538; 430/523; 430/950; 430/603; 430/605; 430/611; 430/613; 430/536; 430/537; 430/567

[58] Field of Search ..... 430/538, 523, 950, 603, 430/605, 611, 613, 536, 537, 567

[56] References Cited

U.S. PATENT DOCUMENTS

| | | | |
|---|---|---|---|
| 4,558,002 | 12/1985 | Aotsuka et al. | 430/538 |
| 4,654,261 | 3/1987 | Takayanagi et al. | 428/336 |
| 4,729,945 | 3/1988 | Anthonsen et al. | 430/538 |
| 4,912,026 | 3/1990 | Miyoshi et al. | 430/611 |
| 4,913,999 | 4/1990 | Tamagawa et al. | 430/538 |
| 5,084,344 | 1/1992 | Harada et al. | 430/538 |

FOREIGN PATENT DOCUMENTS

| | | |
|---|---|---|
| 0256948 | 9/1992 | Japan . |
| 4256948 | 9/1992 | Japan . |
| 0335339 | 11/1992 | Japan . |
| 4335339 | 11/1992 | Japan . |
| 0134345 | 5/1993 | Japan . |
| 5134345 | 5/1993 | Japan . |

*Primary Examiner*—Thomas R. Neville
*Attorney, Agent, or Firm*—Sughrue, Mion, Zinn, Macpeak & Seas

[57] ABSTRACT

A silver halide color photographic photosensitive material comprises a reflective support having thereon at least one photosensitive silver halide emulsion layer. The reflective support comprises a base paper and two or more water-proof resin layers laminated on one surface of the base paper at the side to be coated with the photosensitive emulsion. The water-proof resin layers have different contents of a white pigment. The base paper has pH of from 5 to 9. The silver halide emulsion layer contains silver halide emulsion having a silver chloride content of 95% by moles or higher and being sensitized with selenium, tellurium, or gold.

17 Claims, No Drawings

SILVER HALIDE COLOR PHOTOGRAPHIC PHOTOSENSITIVE MATERIAL AND METHOD OF FORMING COLOR IMAGES

BACKGROUND OF THE INVENTION

The present invention relates to a silver halide color photographic photosensitive material and a method of forming color images. More particularly, the present invention relates to a silver halide color photographic photosensitive material which is superior in image sharpness, is less deteriorated in performance in a long-term storage thereof, and is capable of forming high quality images and to a method of forming color images using this photosensitive material.

Color photography is a process of producing dye images achieved by using a photosensitive material comprising a support having thereon photographic structural layers comprising a silver halide emulsion and dye forming couplers. The photosensitive material is subjected to development processing with an aromatic primary amine color developing agent, resulting in production of an oxidation product of the developing agent. The dye images are formed by reaction of this oxidation product with the dye forming couplers.

Simplified and rapid color development processing is a strong requirement of the color photographic field and various improvements have been achieved. Advanced faster systems have been developed one after another in a cycle of a few years.

To increase a processing speed requires a further approach to shortening time for each of color development, bleach-fixing, washing with water and drying processes. A method of increasing the processing speed is disclosed in, for example, International Patent Publication No. WO 87/04534. This publication discloses a method of rapid processing by using a color photographic photosensitive material comprising high silver chloride emulsion. From the viewpoint of the rapid processing, it would be preferable to use the high silver chloride emulsion.

Such efforts yield a technique of printing images of a color negative on a silver halide color photographic printing paper for high silver chloride printing, which has become a common method for simple and easy production of high-quality images.

In recent years, diversified requirements of the consumer have led to availability of prints of various sizes enlarged at a high rate such as a panorama or high-vision size. Studies have thus been conducted to further improve, rather than to deteriorate, quality of the images including sharpness even in a print enlarged at a high rate.

Various methods are known to improve the sharpness of the silver halide photographic photosensitive material comprising a reflective support. Examples of such methods are: 1) to avoid irradiation by using water-soluble dyes; 2) to avoid halation by using colloidal silver, mordant dyes or particulate solid dyes; and 3) to increase a fill of white pigments in a laminated resin on a paper support or to avoid transmission of light to the support by means of applying the white pigments dispersed in a gelatin to the support as an additional layer.

Of these, the methods 1) and 2) involve adverse effects such as significant deterioration of sensitivity and residual color in processing. On the other hand, for the method 3), JP-A-57-64235 (the term "JP-A" as used herein means an "unexamined" published Japanese patent application), JP-A-62-187846, and U.S. Pat. No. 4,558,002 disclose that the sharpness can be improved significantly by applying a white pigment dispersed in gelatin on a support. However, the white pigment dispersed in the gelatin deteriorates durability and storage stability of the photosensitive material. In addition, the method increases a total thickness of the layers laminated on the support. As a result, other problems occur including deterioration of processing fluctuation, lack of suitability for rapid processing due to an elongated drying time, and increase in costs. Further improvement is therefore required make this method practical.

JP-A-3-156452 and JP-A-3-156439 disclose that the sharpness can be improved significantly by means of increasing a content of a white pigment in a polyolefin laminate on a support. However, manufacturing cost rises with the increased content of the white pigment in the polyolefin, which restricts practical applications of this approach. On the other hand, JP-A-49-30446, JP-A-2-58042, JP-A-1-142549, JP-A-4-256947, and JP-A-4-256948 disclose a reflective support comprising two or more polyolefin layers having different contents of a white pigment. This approach has been found to be favorable by the economical considerations because the above mentioned structure permits a decreased amount of the white pigment used while maintaining the sharpness.

The present inventor had studied silver halide color photographic photosensitive materials, in particular color photographic printing papers, capable of forming images which are excellent in sharpness. As a result, it has been revealed that a high sharpness can be obtained with less amount of white pigment by using a reflective support having two or more layers which are coated with a water-proof resin and which have different contents of the white pigment. As the photosensitive material is stored over a long period of time, it becomes more likely for desensitization due to pressure applied to the photosensitive material to occur.

Accordingly, an object of the present invention is to provide a silver halide color photographic photosensitive material which is superior in image sharpness, and is less deteriorated in performance in a long-term storage thereof as well as to provide a method of forming color images using this photosensitive material.

SUMMARY OF THE INVENTION

The above mentioned object of the present invention can be achieved by the following present invention.

According to a first aspect of the present invention, it is provided with a silver halide color photographic photosensitive material comprising a reflective support having thereon at least one photosensitive silver halide emulsion layer, wherein said reflective support comprises a base paper and two or more water-proof resin layers laminated on one surface of the base paper at the side to be coated with the photosensitive emulsion, the water-proof resin layers having different contents of a white pigment, the base paper having pH of from 5 to 9, and wherein said silver halide emulsion layer contains silver halide emulsion having a silver chloride content of 95% by moles or higher and being sensitized with selenium, tellurium, or gold. It becomes possible to provide a silver halide color photographic photosensitive material which is superior in image sharpness, is less deteriorated in performance in a long-term storage thereof, and is capable of forming images of high-quality, by means of using two or more water-proof resin layers having the different contents of the white pigment and by means of adjusting other conditions to those described above.

In the above mentioned silver halide color photographic photosensitive material according to the present invention, it is preferable that a content of the white pigment in one water-proof resin layer that is closest to the base paper is lower than that in one or more water-proof resin layers exclusive of the one closest to the base paper. The layer closest to the base paper used herein means the lowermost layer. In particular, it is most preferable that the water-proof resin layer that is closest to the photosensitive silver halide emulsion layer has the highest content of the white pigment of the water-proof resin layers.

Titanium dioxide may preferably be used as the white pigment while polyethylene may preferably be used as a water-proof resin to form the water-proof resin layer. With the titanium dioxide used as the white pigment, it is preferable that a content of the titanium dioxide in the water-proof resin layer having the highest content of the white pigment is 15% by weight or higher.

In addition, it is preferable to contain at least one compound represented by any one of the general formulae (I), (II), and (III) described below in the silver halide emulsion layer in order to avoid a density decrease induced on pressure after the photosensitive material is aged.

According to another aspect of the present invention, it is provided with a method of forming color images, in which the silver halide color photographic photosensitive material of the present invention is exposed through a color negative film having a transparent magnetic recording layer, following which color development processing is performed.

According to yet another aspect of the present invention, it is provided with a method of forming color images, in which the silver halide color photographic photosensitive material of the present invention is exposed by using scan exposure with an exposure time of shorter than $10^{-4}$ seconds per one pixel, following which the color development processing is performed.

DETAILED DESCRIPTION OF THE INVENTION

The present invention is described in detail below.

A reflective support according to the present invention has two or more layers which are coated with a water-proof resin (hereinafter, referred to as the layers of the water-proof resin coating). The water-proof resin may be polyolefins such as polyethylene, polypropylene, and polyethylene polymers, and preferably polyethylene. The polyethylene may be high-density polyethylene, low-density polyethylene, low-density linear polyethylene, and a blend of these polyethylenes. A melt flow rate (MFR) of the polyolefin resin before being processed is in a range from 1.2 g to 12 g per 10 minutes measured according to JIS K 7210, Condition 4 in Table 1. The "MFR of the polyolefin resin before being processed" used in this specification means both MFR of the resin before incorporating a bluing agent and a white pigment and MFR thereof before using a diluting resin.

As mentioned above, the white pigment is dispersed in the layers of the water-proof resin coating of the reflective support according to the present invention. Examples of such white pigment include inorganic pigments such as titanium dioxide, barium sulfate, lithopone, aluminum oxide, calcium carbonate, silicon oxide, antimony trioxide, titanium phosphate, zinc oxide, white lead, and zirconium oxide; and organic fine powders such as polystyrene, and styrene-divinylbenzene copolymers.

Of these pigments, the titanium dioxide is a particularly effective one to be used. In this event, the titanium dioxide may be of a rutile or anatase type. However, the anatase type is preferable when whiteness is a precedence while the rutile type is preferable when the sharpness is a precedence. Considering both the whiteness and the sharpness, the anatase titanium dioxide may be blended with the rutile one. It is also preferable that a layer or layers of the water-proof resin coating contain the anatase titanium dioxide and others contain the rutile one. The titanium dioxide may be manufactured through either the sulfate process or the chloride process. Specific examples of the titanium dioxide pigment are KA-10 and KA-20 available from Titan Kogyo Kabushiki Kaisha, and A-220 available from Ishihara Sangyo KK.

The surface of the titanium dioxide pigment used may be generally treated to inhibit activity of titanium dioxide and thereby to avoid yellowing thereof. For example, the pigment surface may be treated with inorganic compounds such as aluminum hydroxide, and silicon hydroxide; with organic compounds such as polyhydric alcohols, polyhydric amine, metallic soap, alkyl titanate, and polysiloxane; or with a combination of inorganic and organic treating agents. The amount of the surface treating agents added is preferably in a range from 0.2% to 2.0% by weight for the inorganic one and from 0.1% to 1.0% by weight for the organic one, relative to the titanium dioxide.

An average pigment diameter of the white pigment used, such as titanium dioxide, is preferably in a range from 0.1 to 0.8 μm. The pigment having a diameter of smaller than 0.1 μm is not preferable because it is less or not uniformly dispersed in the resin. The pigment diameter of larger than 0.8 μm provides insufficient whiteness and causes protuberances formed on the coating surface with an adverse effect on the image quality.

In the reflective support used pursuant to the present invention, the layers of the water-proof resin coating of the support at a side of a photosensitive layer are required to be two or more water-proof resin coatings having different contents of the white pigment. In the present invention, the "layers of the water-proof resin coating having different contents of the white pigment" include a case where only one layer of the water-proof resin coating contains the white pigment and the other does not. The term "content" used herein means a content of the white pigment to the layer of the water-proof resin coating, namely, a ratio of:

$$\text{white pigment}/(\text{white pigment}+\text{resin}).$$

In addition, the content of the white pigment in the layer of the water-proof resin coating that is closest to the support is preferably lower than that in at least one upper layer. A more preferable aspect of the present invention lies in a reflective support having the water-proof resin layers, of which the one closest to the photosensitive layer is higher in content of the white pigment than any other water-proof resin layers. Another preferable aspect lies in a reflective support having at least three water-proof resin layers, of which the interlayer is higher in content of the white pigment than any other water-proof resin layers.

The content of the white pigment in each layer of the multi-layer water-proof resin coating ranges from 0% to 45% by weight, and preferably from 0% to 40% by weight. The content of the white pigment in the layer having the highest content ranges from 9% to 45% by weight, preferably from 15% to 40% by weight, and more preferably from 20% to 40% by weight. The sharpness of the image is small in value with the content of the white pigment of lower than 9% by weight. The content of higher than 45% by weight will cause fractures in a film formed through melt extrusion.

The water-proof resin and the white pigment are mixed with each other in the presence of a dispersing agent. Examples of the dispersing agent are metal salts of higher fatty acids, higher fatty ethyl, higher fatty amide, and higher fatty acids. The white pigment is incorporated in the resin by using a kneading machine such as a two-roll mill, a three-roll mill, a kneader, or a Banbury mixer. The resultant compound is formed into a pellet as a master batch. A concentration of the white pigment in the form of the pellet is typically in a range from 30% to 75% by weight. The dispersing agent may be added in a range from 0.5% to 10% by weight relative to the white pigment.

The layers of the water-proof resin coating are preferably contain a bluing agent. Applicable bluing agents include commonly known ultramarine blue, cobalt blue, oxide cobalt phosphate, quinacridone pigments, and a mixture thereof. While there is no particular limitation on a particle diameter of the bluing agent, the particle diameter of commercially available bluing agents is typically in a range from 0.3 to 10 μm. The particle diameter in this range will not affect in usage. A preferable content of the bluing agent is in a range from 0.1% to 0.5% by weight in the uppermost layer and from 0% to 0.7% by weight in the layer or layers which are located under the uppermost layer, with respect to the base paper.

The bluing agent is incorporated in the water-proof resin by using a kneading machine such as a two-roll mill, a three-roll mill, a kneader, or a Banbury mixer. The resultant compound is formed into a pellet as a master batch. A concentration of the bluing agent ranges from 1% to 30% by weight.

The white pigment may be incorporated in the resin in forming the pellet containing the bluing agent. A dispersing agent may be used to aid dispersion of the bluing agent. Examples of the dispersing agent include water-proof resins of low molecular weight, metal salts of higher fatty acids, higher fatty esters, higher fatty amide, and higher fatty acids.

The water-proof resin may contain an anti-oxidant. A content of such anti-oxidant may advantageously range from 50 to 1,000 ppm relative to the water-proof resin.

The master batch so formed containing the white pigment and/or the bluing agent is adequately diluted for use with the water-proof resin.

To form the multi-layer water-proof resin coating according to the present invention, the above mentioned pellet containing the white pigment and/or the bluing agent is subjected to hot-melt coating on a running support of paper or synthetic paper. If desired, the pellet is diluted before hot-melt coating. The layers may be formed through either successive lamination or other laminations using a multi-layer extrusion die such as a die employing a feed block, a die of a multi-slot type, and a multi-manifold die. The die used is not limited to a specific one and may be any one of common dies such as a T-die or a coat hanger die. An exit orifice temperature in heat melt extrusion of the water-proof resin ranges from 280° to 340° C., and more preferably from 310° to 330° C. Further, before coating the support with resin, it is preferable that the support is subjected to activating treatment with, for example, corona discharges, flame, or glow discharges.

A total thickness of the multi-layer water-proof resin coating and the white pigment composition, which are applied to a base paper of the reflective support used in the present invention at a side for emulsion coating, is preferably in a range from 5 to 100 μm, more preferably from 5 to 80 μm, and most preferably from 10 to 50 μm. With the thickness of larger than 100 μm, the resin becomes relatively brittle and has problems on physical properties such as formation of cracks. The thickness of smaller than 5 μm makes it impossible to achieve water-proofness that is a major purpose of using the resin. In addition, it becomes also impossible to achieve the whiteness along with surface smoothness. Further, an extremely thin layer is soft more than necessary and is thus not preferable with respect to the physical properties.

A thickness of each layer of the multi-layer water-proof resin coating is preferably in a range from 0.5 to 50 μm. For example, with two-layer structure of the water-proof resin coating, it is preferable that a thickness of each layer ranges from 0.5 to 50 μm and the total thickness is in the above mentioned range. With three-layer structure, it is preferable that the thickness of the uppermost layer ranges from 0.5 to 10 μm, that of the interlayer ranges from 5 to 50 μm, and that of the lowermost layer (the layer closest to the support) ranges from 0.5 to 30 μm. The thickness of smaller than 0.5 μm for the uppermost and lowermost layers tends to cause die-lip scoreline due to the action of the white pigment highly filled in the interlayer. On the other hand, the sharpness will be deteriorated with the uppermost and lowermost layers having the thickness exceeding a certain value, in particular with the uppermost layer having the thickness of larger than 10 μm.

A thickness of the resin or resin composition applied to a base paper at a side for non-emulsion coating is preferably in a range from 5 to 100 μm, and more preferably from 10 to 50 μm. With the thickness of exceeding this range, the resin becomes relatively brittle and has problems on physical properties such as formation of cracks. The thickness of smaller than 5 μm makes it impossible to achieve water-proofness that is a major purpose of using the resin. In addition, an extremely thin layer is soft more than necessary and is thus not preferable with respect to the physical properties.

A surface of the uppermost layer of the water-proof resin coating at the side for emulsion coating may be a glossy surface, a fine surface disclosed in JP-A-55-26507 or a matte surface. Alternatively, the surface may be embossed with "silk" pattern. A back-side may have an embossed into, for example, a non-glossy surface. The embossed surface may be subjected to activating treatment with, for example, corona discharges or flame. After completion of the activating treatment, functional back-side coating may be applied to the surface.

The base paper used as the paper support of the photosensitive material according to the present invention has pH ranging from 5 to 9, and more preferably from 5.5 to 8.5.

With the base paper having pH of higher than 9, strength of the support may be reduced in a long-term storage of the photosensitive material and a fog density may be increased. Accordingly, it is necessary to ensure pH of not exceeding 9.

In the present invention, the pH value of the base paper is measured according to provision in JIS P 8133 on hot water extraction. The outline of the hot water extraction prescribed in JIS P 8133 is described below.

A specimen of about 1.0 g is weighed and placed in a 100-ml conical flask, to which distilled water of 20 ml is added. The specimen is immersed in the distilled water with a help of a flat-head stirring rod until the specimen soaks up water uniformly and becomes soft. Additional distilled water of 50 ml is added to the flask and stirred. A cooling tube is then attached to the flask. Subsequently, the flask is placed in a how water bath such that the content of the flask is kept at 95°-100° C. without boiling the distilled water. The content is heated for 1 hour at that temperature while shaking the flask intermittently, following which it is cooled to 20°±5° C. A pH value of the extracted solution is measured by using glass electrodes.

Details of the above mentioned measuring method and instruments for measurement are according to provisions in Japan Industrial Standard (JIS) in 1963.

Now, described are structure of the paper support used in the present invention and a specific procedure for ensuring the pH value of the paper support in the range from 5 to 9.

A base paper used as the paper support is made mainly from wood pulp. While the wood pulp may be soft wood pulp or hard wood pulp, it is preferable in the present invention to use more hard wood pulp of which fiber is relatively short. More specifically, it is preferable that 60% or more of the pulp forming the base paper is the hard wood pulp.

If necessary, a part of the wood pulp may be replaced by synthetic pulp made of, for example, polyethylene or polypropylene, or by synthetic fiber made of, for example, polyester, polyvinyl alcohol or nylon.

A freeness of the whole pulp used is preferably in a range from 150 to 500 ml, and more preferably from 200 to 400 ml, based on provision in CSF. A fiber length after beating is preferably such that a 24+42 mesh residue defined by JIS P 8207 is not more than 40% by weight.

A sizing agent is typically incorporated in base papers. In the present invention, it is preferable to use, as an internal sizing agent, a neutral sizing agent to ensure pH value of the paper support in the range from 5 to 9. Examples of such sizing agent include epoxidized fatty amide, fatty acid anhydrides, resin acid anhydrides, alkenyl succinic anhydride, succinamide, iropropenyl stearate, aziridine compounds, and alkyl ketene dimers.

Base papers typically contain a fixing agent for the sizing agent. In the present invention, it is preferable to use a neutral or weak alkali compound in place of aluminum sulfate which is commonly used as the fixing agent to ensure the pH value of the paper support in the range from 5 to 9. Examples of the neutral or weak alkali compound include cationic starch, polyamide-polyamine epichlorohydrin, polyacrylamide, and polyacrylamide derivatives. Alternatively, the aluminum sulfate may be added and is then neutralized with alkali.

Fillers may be incorporated in the base paper in order to improve the smoothness. The fillers may be, for example, calcium carbonate, talc, clay, kaolin, titanium dioxide, and fine particles of a urea resin.

Additional agents may be incorporated in the base paper other than the above mentioned sizing agent, the fixing agent and the fillers. For example, the base paper may contain strength enhancers; softening agents such as reaction products of maleic anhydride copolymer and polyalkylene-polyamine, and quaternary ammonium of higher fatty acids; color dyes; and fluorescent dyes. As a general rule, these agents have a pH value of or around neutrality to ensure the pH value of the paper support in the range from 5 to 9. An amount of an acidic or alkali agent, if used, is preferably limited to a minimum level.

The base paper used as the paper support is made from the above mentioned stocks by using a fourdrinier machine or a cylinder machine.

A basis weight of the base paper is preferably in a range from 20 to 300 g/m$^2$, and more preferably from 50 to 200 g/m$^2$. A thickness of the base paper is preferably in a range from 25 to 350 μm, and more preferably from 40 to 250 μm.

It is preferable that the base paper is subjected to calendering such as on-machine calendering on the paper making machine or supercalendering of the paper making machine. A density of the base paper after the above mentioned calendering is preferably in a range from 0.7 to 1.2 g/m$^2$, and more preferably from 0.85 to 1.10 g/m$^2$ based on a definition by JIS P 8118.

The "smoothness" is represented on a basis of a surface roughness of the support.

The surface roughness of the support according to the present invention is described. An average surface roughness (SRa) is used as a reference for the surface roughness. The average surface roughness is defined as follows. A portion having an area SM is cut out of a curve of a support section on the center plane thereof. Center lines of the cut-out portion are determined as X and Y axes of a rectangular coordinate while an axis orthogonal to the center lines is determined as a Z axis. The average surface roughness (SRa) is given by:

$$SRa = \frac{1}{SM}\int_0^{L_X}\int_0^{L_Y}|f(X,Y)|\,dX\,dY,$$

where $L_X L_Y = SM$, and $Z = f(X, Y)$. A unit of the average surface roughness is micrometer (μm).

The average surface roughness and a height of the protuberance above the center line can be measured by using a three-dimensional surface roughness measuring machine (SE-30H) available from Kosaka Laboratory Co. Ltd. The measuring conditions are as follows.

| | |
|---|---|
| Diameter of Diamond Spylus | 4 μm |
| Cutoff Value | 0.8 mm |
| Magnification in Horizontal Direction | 20 |
| Magnification in Vertical Direction | 2000 |
| Measured Area | 5 mm$^2$ |

A spylus rate is preferably approximately 0.5 mm/sec. The support preferably has the roughness of not larger than 0.15, obtained according to this measurement, and more preferably not larger than 0.10. A color print having a surface of excellent smoothness can be obtained with the support having such surface roughness (smoothness).

It is possible to adjust the pH value of the base paper to the range from 5 to 9 in the above mentioned method of making the base paper, in particular by means of selecting the incorporated agents (such as incorporated sizing agent and fixing agent) and a surface sizing agent.

In selenium sensitization according to the present invention, unstable selenium compounds are used. Applicable unstable selenium compounds include those disclosed in, for example, JP-B-43-13489 (the term "JP-B" as used herein means an "examined" Japanese patent publication), JP-B-44-15748, JP-A-4-25832, JP-A-4-109240, JP-A-4-271341, and European Patent Publication 0,506,009A.

More specifically, examples of such selenium compounds include: colloidal metal selenium, selenoureas (e.g., N,N-dimethylselenourea, trifluoromethylcarbonyl-trimethylselenourea, and acetyl-trimethylselenourea), seleno amide (e.g., seleno acetoamide, and N,N-diethylphenyl seleno amide), phosphine selenides (e.g., triphenylphosphine selenide, and pentafluorophenyl-triphenylphosphine selenide), seleno phosphates (e.g., tri-p-triseleno phosphate, and tri-n-butylseleno phosphate), seleno ketones (e.g., seleno benzophenone), isoselenocyanates, seleno carboxylates, seleno esters, and diacyl selenides. In addition, non-unstable selenium compounds disclosed in, for example, JP-B-46-4553 and JP-B-52-34492 may also be applied. Examples of the non-unstable selenium compounds include selenious acid, seleno potassium cyanate, selenazoles and selenides.

In tellurium sensitization, unstable tellurium compounds are used. Applicable unstable tellurium compounds include those disclosed in, for example, Canadian Patent No. 800,958, British Patent Nos. 1,295,462 and 1,396,696, JP-A-4-204640, JP-A-4-271341, JP-A-4-33043, and Japanese Patent Application No. 4-129787.

More specifically, examples of such tellurium compounds include telluroureas (e.g., tetramethyltellurourea, N,N'-dimethylethylenetellurourea, and N,N'-diphenylethylenetellurourea), phosphine tellurides (e.g., butyl-diisopropyl phosphine telluride, tributyl phosphine tellurides, tributoxy phosphine telluride, and ethoxy-diphenyl phosphine telluride), diacyl (di)tellurides (e.g., bis(diphenylcarbamoyl)ditelluride, bis(N-phenyl-N-methylcarbamoyl)ditelluride, bis(N-phenyl-N-methylcarbamoyl)telluride, and bis(ethoxycarbonyl)-telluride), isotellurocyanates, telluro amide, telluro hydrazides, telluro esters (e.g., butylhexyl telluro ester), telluroketones (e.g., telluroacetophenone) colloidal tellurium, (di)tellurides, other tellurium compounds (e.g., potassium telluride, and telluropentathionate sodium salt).

Specific examples of sensitizers for gold sensitization are chloraurate, potassium chloraurate, potassium aurithiocyanate, gold sulfide, and gold selenide as well as gold compounds disclosed in, for example, U.S. Pat. Nos. 2,642,361, 5,049,484, and 5,049,485.

The above mentioned chemical sensitization may be performed alone. Alternatively, a combination of two or more types of sensitization may be used. It is also preferable to combine sulfur sensitization and reduction sensitization.

In the present invention, it is preferable to use tellurium or gold sensitization.

An amount of the selenium or tellurium sensitizing agent used in the present invention is preferably in a range from $10^{-8}$ to $10^{-2}$ moles, and more preferably from $10^{-7}$ to $5\times10^{-3}$ moles per one mole of the silver halide, though depending on silver halide grains used and conditions of chemical sensitization.

An amount of the gold sensitizing agent used in the present invention is preferably in a range from $10^{-7}$ to $10^{-2}$ moles per one mole of the silver halide.

The conditions of chemical sensitization in the present invention are not limited specifically. However, pAg preferably ranges from 5 to 9, and more preferably from 6 to 8.5 while pH ranges from 4 to 10. In addition, a temperature is in a range from 40° to 95° C., and preferably from 45° to 85° C.

In the present invention, it is possible to further restrict a decrease in density due to pressure which may be applied to the aged photosensitive material by means of containing the compounds represented by the general formulae (I), (II), and (III) in a silver halide emulsion layer. To incorporate these compounds in the silver halide emulsion layer, the compounds may be dispersed directly in the emulsion. Alternatively, in order to add the compounds to the emulsion, the compounds may be dissolved in single or mixed solvent of water or methanol. The compounds may be added to the emulsion in any stages from in emulsion preparation to just before coating. However, it is preferable to add the compounds in preparation of the coating solution. An amount of the compounds represented by the general formulae (I), (II), and (III) added is preferably in a range from $1\times10^{-5}$ to 1 mol, and more preferably in a range from $1\times10^{-3}$ to $5\times10^{-1}$ moles per one mole of the silver halide.

The compound represented by the general formula (I) is described in detail below.

In the formula, $X^1$ and $Y^1$ each represents a hydroxyl group, $—NR^{15}R^{16}$, or $—NHSO_2R^{17}$. $R^{11}$, $R^{12}$, $R^{13}$, and $R^{14}$ each represents a hydrogen atom or a substituent. Examples of the substituents include an alkyl group (preferably having from 1 to 20 carbon atoms; e.g., methyl, ethyl, octyl, hexadecyl, and t-butyl), an aryl group (preferably having from 6 to 20 carbon atoms; e.g., phenyl, and p-tolyl), an amino group (preferably having from 0 to 20 carbon atoms; e.g., amino, diethylamino, diphenylamino, and hexadecylamino), amide (preferably having from 1 to 20 carbon atoms; e.g., acetylamino, benzoylamino, octadecanoylamino, and benzenesulfonamide), an alkoxy group (preferably having from 1 to 20 carbon atoms; e.g., methoxy, ethoxy, and hexadecyloxy), an alkylthio group (preferably having from 1 to 20 carbon atoms; e.g., methylthio, butylthio, and octadecylthio), an acyl group (preferably having from 1 to 20 carbon atoms; e.g., acetyl, hexadecanoyl, benzoyl, and benzenesulfonyl), a carbamoyl group (preferably having from 1 to 20 carbon atoms; e.g., carbamoyl, N-hexylcarbamoyl, and N,N-diphenylcarbamoyl), an alkoxycarbonyl group (preferably having from 2 to 20 carbon atoms; e.g., methoxycarbonyl, and octyloxycarbonyl), a hydroxyl group, a halogen atom (e.g., F, Cl, and Br), a cyano group, a nitro group, a sulfo group, and a carboxyl group. These substituents may further be substituted by one or more other substituents (such as those given for $R^{11}$). At least one of $R^{11}$–$R^{12}$ and $R^{13}$–$R^{14}$ each represents atomic groups necessary to form a carbon ring (preferably a five- to seven-membered ring) in cooperation with each other. $R^{15}$ and $R^{16}$ each represents a hydrogen atom, an alkyl group (preferably having from 1 to 10 carbon atoms; e.g., ethyl, hydroxyethyl, and octyl), an aryl group (preferably having from 6 to 10 carbon atoms; e.g., phenyl, and naphthyl), or a heterocyclic group (preferably having from 2 to 10 carbon atoms; e.g., 2-furanyl, and 4-pyridyl). These compounds may further be substituted by one or more substituents (such as those given for $R^{11}$). $R^{15}$ and $R^{16}$ may represent atomic groups necessary to form a heterocyclic ring (preferably a five- to seven-membered ring) in cooperation with each other. $R^{17}$ is an alkyl (preferably having from 1 to 20 carbon atoms; e.g., ethyl, octyl, and hexadecyl), an aryl group (preferably having from 6 to 20 carbon atoms; e.g., phenyl, p-tolyl, and 4-dodecyloxyphenyl), an amino group (preferably having from 0 to 20 carbon atoms; e.g., N,N-diethylamino, N,N-diphenylanimo, and mono hollunium), or a heterocyclic group (preferably having from 2 to 20 carbon atoms; e.g., 3-pyridyl). These groups may further be substituted by one or more substituents.

In the formula (I), $X^1$ preferably represents —NH-$SO_2R^{17}$. Each of $R^{11}$, $R^{12}$, $R^{13}$, and $R^{14}$ preferably represents a hydrogen atom, an alkyl group, amide, a halogen atom, a sulfo group, or a carboxyl group.

The compound represented by the general formula (II) is described in detail below.

In the formula, $X^2$ and $Y^2$ each represents a hydroxyl group, —$NR^{23}R^{24}$, or —$NHSO_2R^{25}$. $R^{21}$ and $R^{22}$ each represents a hydrogen atom or a substituent. The substituents are, for example, those given for $R^{11}$. $R^{21}$ and $R^{22}$ may represent atomic groups necessary to form a carbon ring or a heterocyclic ring (preferably each of which is a five- to seven-membered ring) in cooperation with each other. $R^{23}$ and $R^{24}$ each represents a hydrogen atom, an alkyl group, an aryl group, or a heterocyclic group, of which examples are similar to those given for $R^{15}$. $R^{23}$ and $R^{24}$ may represent atomic groups necessary to form a heterocyclic ring containing a nitrogen atom (preferably a five- to seven-membered ring) in cooperation with each other. $R^{25}$ represents an alkyl group, an aryl group, an amino group, or a heterocyclic group, of which examples are similar to those given for $R^{17}$.

In the formula (II), $X^2$ preferably represents —$NR^{23}R^{24}$ or —$NHSO_2R^{25}$. Each of $R^{21}$ and $R^{22}$ preferably represents a hydrogen atom, an alkyl group, or an aryl group. Alternatively, $R^{21}$ and $R^{22}$ represent atomic groups necessary to form a carbon ring or a heterocyclic ring in cooperation with each other. Examples thereof are similar to those given for $R^{15}$.

The compound represented by the general formula (III) is described in detail below.

In the formula, $X^3$ represents a hydroxyl group or —$NR^{32}R^{33}$. $Y^3$ represents —CO— or —$SO_2$. $R^{31}$ represents a hydrogen atom or a substituent (such as those given for $R^{11}$). n represents 0 or 1.

$R^{32}$ and $R^{33}$ each represents a hydrogen atom, an alkyl group, an aryl group, or a heterocyclic group, of which examples are similar to those given for $R^{15}$. $R^{31}$ and $R^{32}$, or $R^{32}$ and $R^{33}$ may represent atomic groups necessary to form a heterocyclic ring (preferably a five- to seven-membered ring) in cooperation with each other.

In the formula (III), $X^3$ preferably represents —$NR^{32}R^{33}$ while $Y^3$ preferably represents —CO—. $R^{31}$ preferably represents a hydrogen atom, an alkyl group, an aryl group, an alkoxy group, an aryloxy group, or an amino group, which may further be substituted by a substituent (such as those given for $R^{11}$). Each of $R^{32}$ and $R^{33}$ preferably represents a hydrogen atom or an alkyl group.

Specific examples of the compound represented by the general formula (I), (II) or (III) are given below. It should be noted that the present invention is not limited to those specific examples.

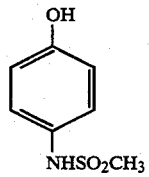

(I)-1

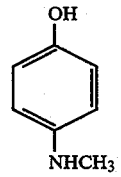

(I)-2

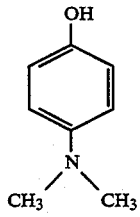

(I)-3

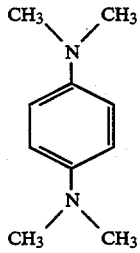

(I)-4

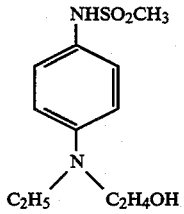

(I)-5

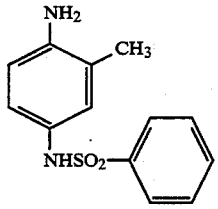

(I)-6

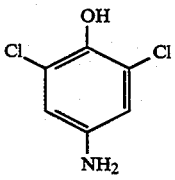

(I)-7

-continued
(I)-8
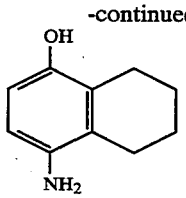
(I)-9
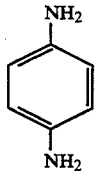
(I)-10
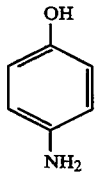
(I)-11
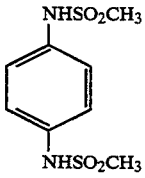
(I)-12
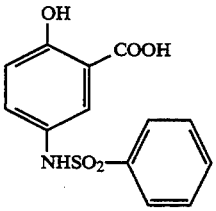
(I)-13
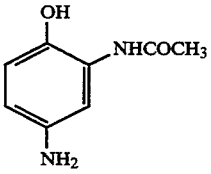
(I)-14
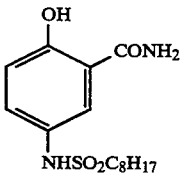
(I)-15
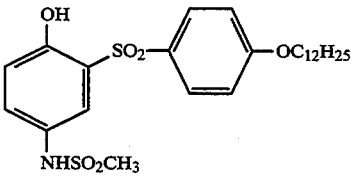
(I)-16
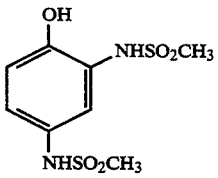
-continued
(II)-1
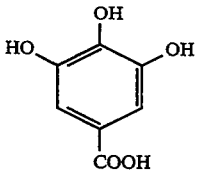
(II)-2
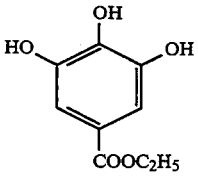
(II)-3)
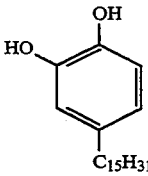
(II)-4
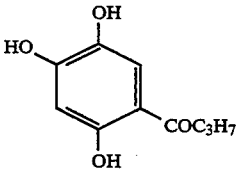
(II)-5
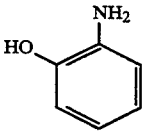
(II)-6
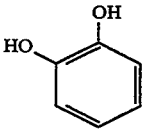
(II)-7
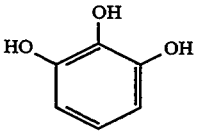
(II)-8
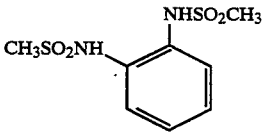
(II)-9
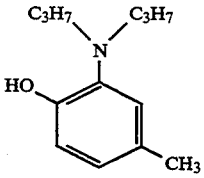

-continued
(II)-10
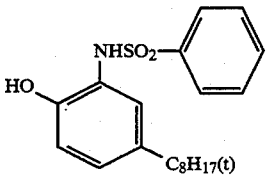
(II)-11
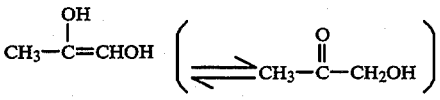
(II)-12
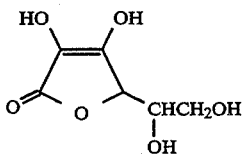
(II)-13
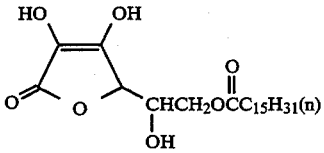
(II)-14
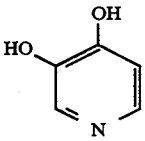
(II)-15
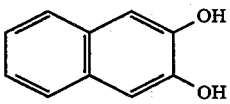
$NH_2NH_2$ (III)-1
(III)-2
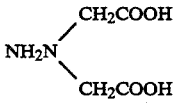
$CH_3CONHNH_2$ (III)-3
(III)-4
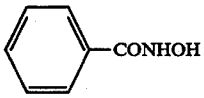
(III)-5
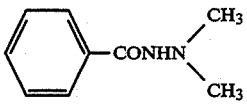
$NH_2CONHNH_2$ (III)-6
(III)-7
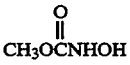
-continued
(III)-8
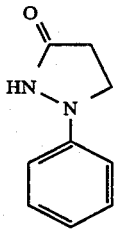
(III)-9
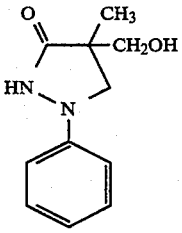
(III)-10)
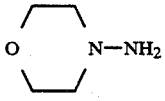
(III)-11
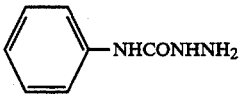
$NH_2NHCONHNH_2$ (III)-12)
(III)-13
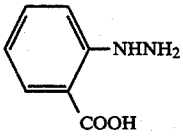
(III)-14
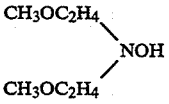
(III)-15
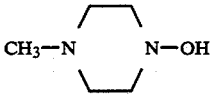
$CH_3NHNHCH_3$ (III-16)
$(t)C_4H_9HNOH$ (III)-17
(III)-18
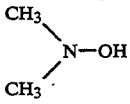
(III)-19
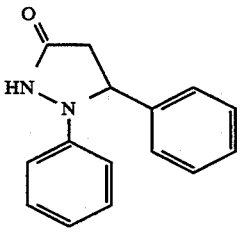

-continued (III)-20

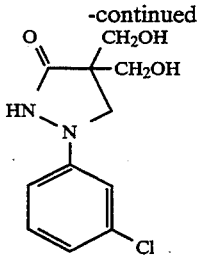

(III)-21

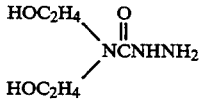

(III)-22

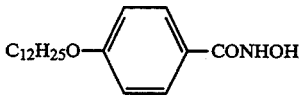

(III)-23

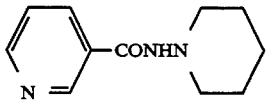

(III)-24

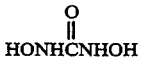

(III)-25

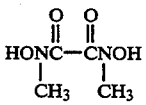

(III)-26

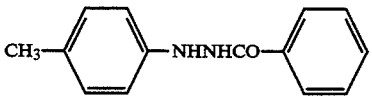

(III)-27

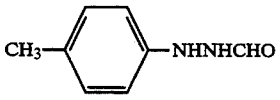

It is possible to further restrict reduction of concentration due to pressure expected to be applied to the aged photosensitive material by means of adding a heterocyclic mercapto compound in the silver halide emulsion.

Preferable heterocyclic mercapto compound used in the present invention is represented by the following general formula (IV):

(IV)

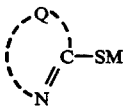

wherein Q represents atomic groups required for forming a five- or six-membered heterocyclic ring or five- or six-membered heterocyclic ring to which a benzene ring is condensed, and M represents a cation.

The compound having the general formula (IV) is described more specifically.

A heterocyclic ring formed by Q may be, for example, an imidazole ring, a tetrazole ring, a thiazole ring, an oxazole ring, a selenazole ring, a benzoimidazole ring, a naphthoimidazole ring, a benzothiazole ring, a benzoselenazole ring, a naphthoselenazole ring or a benzoxazole ring.

A cation represented by M may be, for example, a hydrogen ion, alkali metals (such as sodium and potassium) or an ammonium group.

The compound represented by the general formula (IV) is preferably a mercapto compound represented by one of the following general formulae (IV-1), (IV-2), (IV-3) and (IV-4).

(IV-1)

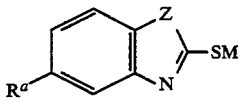

wherein $R^A$ represents a hydrogen atom, an alkyl group, an alkoxy group, an aryl group, a halogen atom, a carboxyl group or a salt thereof, a sulfo group or a salt thereof, or an amino group; Z represents —NH—, —O— or —S—; and M is similar to that in the general formula (IV).

(IV-2)

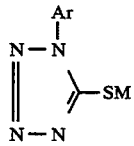

wherein Ar represents

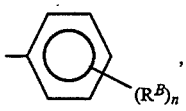

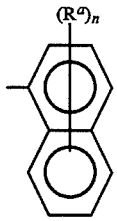

or

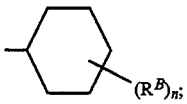

$R^B$ represents an alkyl group, an alkoxy group, a carboxyl group or a salt thereof, a sulfo group or a salt thereof, a hydroxyl group, an amino group, an acylamino group, a carbamoyl group or a sulfamide; n represents an integer of from 0 to 2; and M is similar to that in the general formula (IV).

In the general formulae (IV-1) and (IV-2), the alkyl group represented by $R^A$ and $R^B$ includes, for example, methyl, ethyl and butyl. The alkoxy group represented by $R^A$ and $R^B$ includes, for example, methoxy and ethoxy. A salt of the carboxyl group or the sulfo group includes, for example, a sodium salt and an ammonium salt.

In the general formula (IV-1), the aryl group represented by $R^A$ includes, for example, phenyl and naphthyl while the halogen atom represented by $R^A$ includes, for example, a chloride atom and a bromide atom.

In the general formula (IV-2), the acylamino group represented by $R^B$ includes, for example, methylcarbonylamino and benzoylamino while the carbamoyl group represented by $R^B$ includes, for example, ethylcarbamoyl and phenylcarbamoyl. The sulfamide represented by $R^B$ includes, for example, methylsulfamido and phenylsulfamido.

The above mentioned alkyl, alkoxy, aryl, amino, acylamino, carbamoyl groups and the sulfamide may have one or more substituents. The substituent may be, in the amino group for example, the amino group of which alkylcarbamoyl group is substituted, i.e., an alkyl-substituted ureido group.

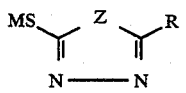

(IV-3)

wherein Z represents —N($R^{A1}$)—, an oxygen atom or a sulfur atom. R represents a hydrogen atom, an alkyl group, an aryl group, an alkenyl group, a cycloalkyl group, —$SR^{A1}$—, —N($R^{A2}$)$R^{A3}$—, —$NHCOR^{A4}$—, —$NHSO_2$, $R^{A5}$ or a heterocyclic group; $R^{A1}$ represents a hydrogen atom, an alkyl group, an alkenyl group, a cycloalkyl group, an aryl group, —$COR^{A4}$ or —$SO_2$-$R^{A5}$; $R^{A2}$ and $R^{A3}$ each represents a hydrogen atom, an alkyl group or an aryl group; and $R^{A4}$ and $R^{A5}$ each represents an alkyl group or an aryl group. M is similar to that in the general formula (IV).

In the general formula (IV-3), the alkyl group of $R^{A1}$, $R^{A2}$, $R^{A3}$, $R^{A4}$ or $R^{A5}$ may be, for example, methyl, benzyl, ethyl or propyl, and the aryl group may be, for example, phenyl or naphthyl.

In addition, the alkenyl and cycloalkyl groups of R or $R^{A1}$ may be, for example, propenyl and cyclohexyl, respectively. The heterocyclic group of R may be, for example, furyl or pyridinyl.

The alkyl and aryl groups each represented by $R^{A1}$, $R^{A2}$, $R^{A3}$, $R^{A4}$ or $R^{A5}$, the alkenyl and cycloalkyl groups each represented by R or $R^{A1}$ and the heterocyclic group represented by R may have one or more substituents.

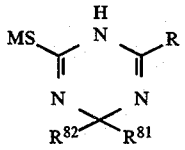

(IV-4)

wherein R and M are same as R and M in the general formula (IV-3), respectively; $R^{B1}$ and $R^{B2}$ are same as $R^{A1}$ and $R^{A2}$ in the general formula (IV-3), respectively.

Specific examples of the compound represented by the general formula (IV) are given below. It should be noted that the present invention is not limited to those specific examples.

IV-1-1

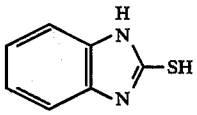

IV-1-2

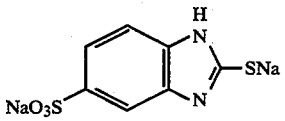

IV-1-3

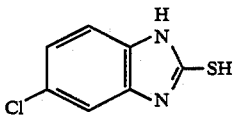

IV-1-4

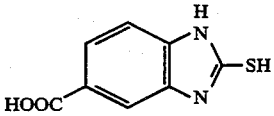

IV-1-5

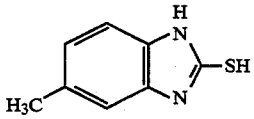

IV-1-6

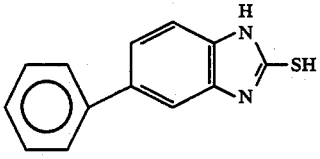

IV-1-7

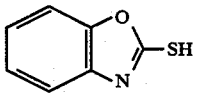

IV-1-8

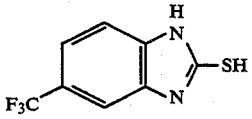

IV-2-2

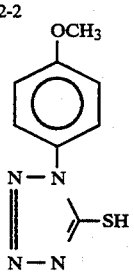

IV-2-2

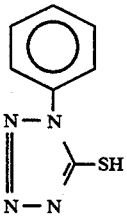

IV-2-3

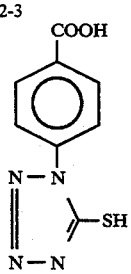

-continued
IV-2-4
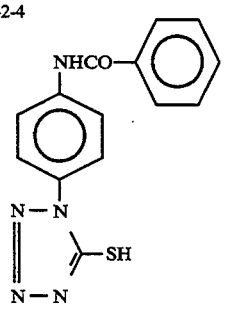
IV-2-5
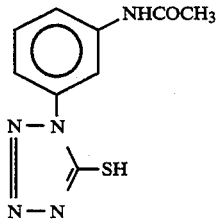
IV-2-6
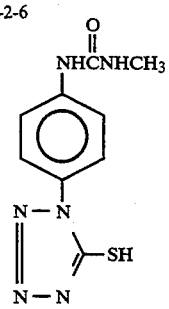
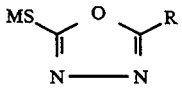
| COMPOUND | R | M |
|---|---|---|
| IV-3-1 | $-C_2H_5$ | —H |
| IV-3-2 | $-CH_2-CH-CH_2$ | —H |
| IV-3-3 | $-CH=CH-CH_2-CH_3$ | —H |
| IV-3-4 | $-C_7H_{15}$ | —H |
| IV-3-5 | $-C_9H_{19}$ | —Na |
| IV-3-6 | 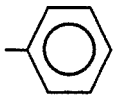 | —H |
| IV-3-7 | $-C_4H_9(t)$ | —H |
| IV-3-8 | 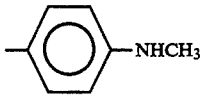 | —H |
| IV-3-9 | 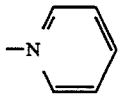 | —H |
| IV-3-10 | 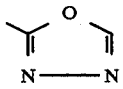 | —H |
| IV-3-11 | 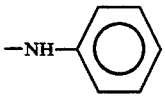 | —H |
| IV-3-12 | 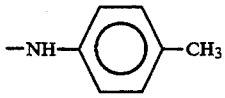 | $-NH_4$ |
| IV-3-13 | $-NHCOCH_3$ | —H |
| IV-3-14 | 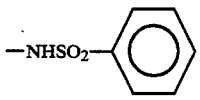 | —H |
| IV-3-15 | $-N(CH_3)_3$ | —H |
| IV-3-16 | 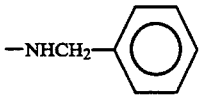 | —H |

-continued
| | | |
|---|---|---|
| IV-3-17 | 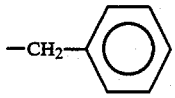 | —H |
| IV-3-18 | —S—$CH_3$ | —H |
| IV-3-19 | 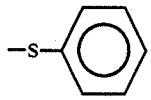 | —H |
| IV-3-20 | —SH | —H |
| IV-3-21 | —H | —H |
| IV-3-22 | —$C_2H_5$ | —H |
| IV-3-23 | —$C_4H_9$(t) | —H |
| IV-3-24 | —$C_6H_{13}$ | —H |
| IV-3-25 | 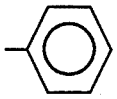 | —H |
| IV-3-26 | 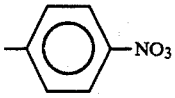 | —H |
| IV-3-27 | 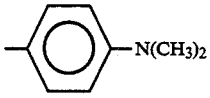 | —H |
| IV-3-28 | 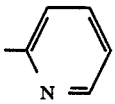 | —H |
| IV-3-29 | 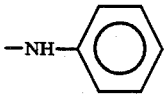 | —H |
| IV-3-30 | —$NH_2$ | —H |
| IV-3-31 | —$CH_2CH{=}CH_2$ | —H |
| IV-3-32 | —SH | —H |
| IV-3-33 | —$NHCOC_2H_5$ | —H |
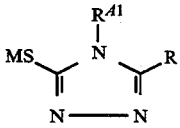
| COMPOUND | R | $R^{A1}$ | M |
|---|---|---|---|
| IV-3-34 | —$C_2H_5$ | —H | —H |
| IV-3-35 | —$CH_3$ | —$CH_3$ | —H |
| IV-3-36 | —$CH_3$ | 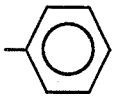 | —H |
| IV-3-37 | —$NHCOCH_3$ | —$CH_3$ | —H |
| IV-3-38 | 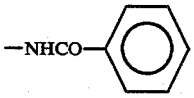 | 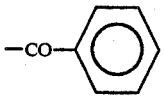 | —H |
| IV-3-39 | —$NHCOCH_3$ | —$COCH_3$ | —H |

-continued

| | | | |
|---|---|---|---|
| IV-3-40 | $-NHCOCH_3$ | 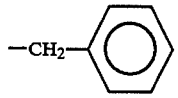 | $-H$ |

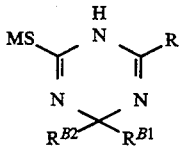

| COMPOUND | R | $R^{B1}$ | $R^{B2}$ | M |
|---|---|---|---|---|
| IV-4-1 | $-C_2H_5$ | $-CH_3$ | $-CH_3$ | $-H$ |
| IV-4-2 | 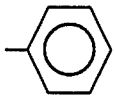 | $-CH_3$ | $-CH_3$ | $-H$ |
| IV-4-3 | $-NH_2$ | $-H$ | 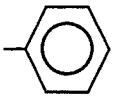 | $-H$ |
| IV-4-4 | 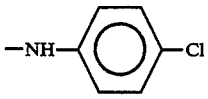 | $-CH_3$ | $-C_4H_9$ | $-H$ |
| IV-4-5 | $-NHCOCH_3$ | $-CH_3$ | $-CH_3$ | $-H$ |
| IV-4-6 | 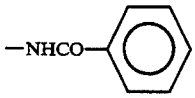 | $-CH_3$ | $-CH_3$ | $-H$ |
| IV-4-7 | 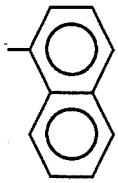 | $-CH_3$ | $-C_3H_7(i)$ | $-H$ |
| IV-4-8 | 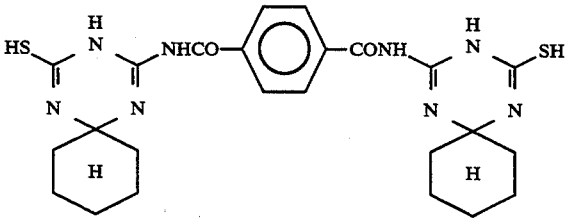 | | | |

An amount of the compound represented by the general formula (IV) added to the silver halide emulsion is preferably from $1\times10^{-5}$ to $5\times10^{-2}$ mol, and more preferably from $1\times10^{-4}$ to $1\times10^{-2}$ mol, per one mol of the silver halide. A method of addition is not limited to a specific one and the compound may be added in any stages of formation of the silver halide grains, physical ripening, chemical ripening and preparation of the coating solution.

The color photosensitive material according to the present invention is formed by means of applying to a support having a reflective layer at least one yellow developing silver halide emulsion layer, at least one magenta developing silver halide emulsion layer, and at least one cyan developing silver halide emulsion layer. In typical color photographic printing papers, subtractive color processes can be achieved by means of containing, in the silver halide emulsion layers, color dye-forming couplers which form dyes having complementary color to light to which the silver halide emulsion is sensitive. In the typical color photographic printing papers, silver halide emulsion grains are spectrally sensitized with blue-sensitive, green-sensitive, and red-sensitive spectral sensitizing dyes in the above mentioned color developing layers in that order. In addition, the support may have blue-sensitive, green-sensitive, and red-sensitive silver halide emulsion layers formed thereon in this order by coating. However, the order of coating may be altered. In some cases, it may be preferable that the uppermost layer is a sensitive layer containing the silver halide grains with the largest average grain size in view of rapid processing. In other cases, it may be preferable that the lowermost layer is a magenta developing layer in view of durability under exposure to light.

Further, the sensitive layers and the developed hue may not be in the above mentioned relation. Instead, at least one infrared-sensitive silver halide emulsion layer may be used.

A silver halide grain according to the present invention is required to comprise silver chloride, silver chlorobromide or silver iodochlorobromide. The silver halide grain is also required to have silver chloride contents of 95% by mole or higher. In particular, in the present invention, each silver halide grain preferably comprises silver chlorobromide or silver chloride and contains substantially no silver iodide to increase developing speed. The term "contains substantially no silver iodide" used herein means the silver iodide contents of lower than 1.0% by mole, and preferably lower than 0.2% by mole. On the other hand, high silver chloride grains may sometimes be used advantageously that contain from 0.01% to 3% by mole of silver iodide on the surface thereof as those disclosed in JP-A-3-84545 in order to improve sensitivity under higher intensity of illumination, to improve the spectral sensitivity, or to improve aging stability of the photosensitive material.

The halogen composition of the emulsion may be different from grain to grain or same for all grains. However, to use an emulsion comprising the grains having the same halogen composition facilitates achievement of uniform properties of the grains. For distribution of the halogen composition in the silver halide emulsion grain, the grain may be a so-called uniform-structured grain in which the composition is identical at any portion of the silver halide grain. Alternatively, the grain may be so-called core-shell grain comprising a core in the internal part of the silver halide grain and a shell (one or more layers) enclosing the core which are different from each other in the halogen composition. In addition, also applicable are any other grains having two or more non-layer phases in the internal part or on the surface thereof which are different from each other in the halogen composition. The non-layer phase on the surface of the grain, if any, results from bonding of a layer having unlike composition to an edge, a corner or a surface. Either the latter two types of grains can advantageously be used rather than the uniform-structured grain for achieving high sensitivity and are also preferable by the pressure resistant considerations. When the silver halide grains having the above mentioned structure are used, a boundary between adjacent phases that are different from each other in the halogen composition may be a distinct boundary or an indistinct boundary with mixed crystals formed due to a difference in composition. In addition, the silver halide grain may be provided with actively a continuous structural change.

In the high silver chloride emulsion according to the present invention, the grain preferably has a silver bromide localized phase of a layer shape or a non-layer shape in the internal part or on the surface of the silver halide grain. The halogen composition of the localized phase is preferably at least 10% by mole, and more preferably higher than 20% by mole, based on the silver bromide content. The content of the silver bromide in the silver bromide localized phase may be measured by using, for example, X-ray diffraction (disclosed in, for example, "Shin Jikken Kagaku Koza 6: Kozo Kaiseki (Text of New Experimental Chemistry: Structural Analysis), edited by Japan Chemical Associates, published by Maruzen). The localized phase may exist in the internal part, on an edge, corner or surface of the grain. A preferable example of the localized phase is grown epitaxially on the corner of the grain.

In addition, it is also advantageous to further increase the silver chloride content in the silver halide emulsion in order to reduce replenishment rate of the developing solution. In this event, emulsions containing substantially pure silver chloride are preferably used with the silver chloride contents of from 98% to 100% by mole.

An average grain size (an average of grain sizes each corresponding to a diameter of a circle equivalent to a projection area of the grain) of the silver halide grains contained in the silver halide emulsion used in the present invention preferably ranges from 0.1 μm to 2 μm.

The emulsion is preferably so-called mono-dispersed in which a grain size distribution is 20% or less, preferably 15% or less, and more preferably 10% or less expressed as a fluctuation coefficient (obtained by dividing a standard deviation of the grain size distribution by the average grain size). In this event, the above mentioned mono-disperse emulsions may be blended in a same layer or laminated to achieve a wide latitude.

The silver halide grains contained in the photographic emulsion may have a regular crystal shape such as cube, tetradecahedron, or octahedron. Alternatively, they may have an irregular crystal shape such as sphere or tablet, and otherwise, they may have any one of composite shapes. In addition, silver halide grains having two or more types of shape may be used together. In the present invention, 50% or more, preferably 70% or more, and more preferably 90% or more of the silver halide grains are those having the above mentioned regular crystal shape.

Such emulsions may also be used that contain tabular silver halide grains, 50% of a total projection area of all grains therein is occupied by tabular silver halide grains having an aspect ratio (diameter determined by stereographic projection/thickness) of 5 or greater, and more preferably 8 or greater.

A silver chloride/chlorobromide emulsion used in the present invention may be prepared through a method disclosed in, for example, P. Glafkides, "Chimie et Phisique Photographique (Photographic Chemistry and Physics)," Paul Montel, 1967; G. F. Duffin, "Photographic Emulsion Chemistry," Focal Press, 1966; and V. L. Zelikman et al., "Making and Coating Photographic Emulsion," Focal Press, 1964. More specifically, the silver chlorobromide emulsion may be prepared according to any one of an acid method, a neutral method and an ammonium method. If such a technique is used that a soluble silver salt and a soluble halogen salt are reacted with each other, any one of one-side mixing, simultaneous mixing and a combination thereof may be used. Alternatively, a method where the grains are formed in an atmosphere with excessive silver ions (so-called reverse mixing) may be used. As one form of the simultaneous mixing, a so-called controlled double jet method may be used where pAg in a liquid phase formed of the silver halide is kept constant. With this method, the silver halide grains obtained have regular crystal shapes and are approximately uniform in grain sizes.

The localized phase on the silver halide grains or substrates thereof preferably contains diverse metal ions or complex ions thereof. A preferable metal is selected from the group consisting of metal ions belonging to groups VIII and IIb of the periodic table, metal complexes, lead ions, and thallium ions. The locarlized phase mainly contains, for example, ions of the compound selected from the group consisting of iridium, rhodium, and iron, or complex ions thereof. The substrate mainly contains, for example, a combination of metal ions of the compound selected from the group consisting of osmium, iridium, rhodium, platinum, ruthenium, palladium, cobalt, nickel, and iron, or complex ions thereof. The localized phase may contain the metal ions which are different in type and content from those contained in the substrate. Two or more kinds of metals may be used together. In particular, it is preferable that the silver bromide localized phase contains iron and iridium compounds.

The metal ion providing compounds may be added, in forming the silver halide grains, to the localized phase and/or other portions (substrate) of the silver halide grains according to the present invention by means of dissolving it in an aqueous solution of gelatin which serves as a dispersing medium, in an aqueous solution of halide, in an aqueous solution of silver salt, or in any other solutions. Alternatively, the metal ion may be added previously to the fine silver halide grains and these fine grains are dissolved in the dispersing medium.

The metal ion used in the present invention may be added to the emulsion grains at any time before, during, and just after grain formation. The timing may be varied depending on in which position of the grain the metal ion should be contained.

Various compounds and precursors thereof may be added to the silver halide emulsion used in the present invention to avoid fogging during manufacture process, storage or photographic processing of the photosensitive material or to stabilize photographic performance. A specific example of these compounds is disclosed in JP-A-62-215272, pages 39–72. In addition, 5-arylamino-1,2,3,4-thiatriazole compound disclosed in European Patent No. 0,447,647 is also preferably used, in which the aryl residue has at least one electron withdrawing group.

The spectral sensitization is made to impart spectral sensitivity to a desired wavelength range to the emulsion of each layer of the photosensitive material according to the present invention.

The spectral sensitizing dyes are used for the spectral sensitization in blue, green, and red range of the spectra in the photosensitive material according to the present invention. The spectral sensitizing dyes used may be, for example, those disclosed in "Heterocyclic compounds-Cyanine dies and related compounds" (John Wiley & Sons [New York, London], 1964. Preferable examples of the specific compounds and methods of the spectral sensitization used are those disclosed in the above mentioned JP-A-62-215272, page 22, upper right column to page 38. In addition, a spectral sensitizing dye disclosed in JP-A-3-123340 is preferable as the spectral sensitizing dye having sensitization in the red range for the high silver chloride emulsion grains in view of strength of adsorption of the dye to the silver halide and temperature dependence in exposure.

To effectively sensitizing in the infrared range of the spectrum in the photosensitive material according to the present invention, such sensitizing dyes are preferably used that are disclosed in JP-A-3-15049, page 12, upper left column, page 12 to page 21, lower left column; JP-A-3-20730, page 4, lower left column to page 15, lower left column; European Patent No. 0,420,011, page 4, line 21 to page 6, line 54; European Patent No. 0,420,012, page 4, line 12 to page 10, line 33; European Patent No. 0,443,466; and U.S. Pat. No. 4,975,362.

The spectral sensitizing dyes may be directly dispersed in the silver halide emulsion. Alternatively they may be dissolved in a single or mixed solvent of, for example, water, methanol, ethanol, propanol, methyl Cellosolve, and 2,2,3,3-tetrafluoropropanol, and then added to the emulsion. In addition, the spectral sensitizing dyes may be dissolved in an aqueous solution along with an acid or a base and added to the emulsion as disclosed in, for example, JP-B-44-23389, JP-B-44-27555, and JP-B-57-22089. Alternatively, the spectral sensitizing dyes may be dissolved in an aqueous solution or a colloid dispersion along with a surfactant and added to the emulsion as disclosed in, for example, U.S. Pat. Nos. 3,822,135, and 4,006,025. The spectral sensitizing dyes may be dissolved in a substantially water-immiscible solvent such as phenoxyethanol, which is then dispersed in water or a hydrophilic colloid and added to the emulsion. The spectral sensitizing dyes may be dispersed directly in a hydrophilic colloid and the dispersion may be added to the emulsion as disclosed in JP-A-53-102733, and JP-A-58-105141. The dispersion may be added to the emulsion at any timing in preparation of the emulsion when is found to be effective. More specifically, the timing may be before formation of the silver halide emulsion grains, during formation thereof, just after formation thereof, before rinsing process, before, during, and just after the chemical sensitization, before chilling and solidifying the emulsion, and in preparation of the coating solution. Typically, the spectral sensitizing dyes are added to the emulsion after completion of the chemical sensitization and before coating of the emulsion to the support. The spectral sensitizing dyes may be, however, added along with a chemical sensitizing agent to achieve the spectral sensitization at the same time as the chemical sensitization as disclosed in U.S. Pat. Nos. 3,628,969, and 4,225,666. Alternatively, the spectral sensitizing dyes may be added prior to the chemical sensitization as disclosed in JP-A-58-113928. In addition, the spectral sensitizing dyes may be added before completion of precipitation formation of the silver halide grains to start the spectral sensitization. Further, the spectral sensitizing dyes may be added separately as disclosed in U.S. Pat. No. 4,225,666. More specifically, a part of the spectral sensitizing dyes may be added prior to the chemical sensitization and the remainder may be added thereafter. The spectral sensitizing dyes may thus be added at any time in formation of the silver halide grains in a manner disclosed in, for example, U.S. Pat. No. 4,183,756. It is, however, preferable that the sensitizing dyes are added before emulsion rinsing process or before the chemical sensitization.

An amount of the spectral sensitizing agent added, which varies widely depending on necessity, is preferably in a range from $0.5\times10^{-6}$ to $1.0\times10^{-2}$ moles, and more preferably from $1.0\times10^{-6}$ to $5.0\times10^{-3}$ moles per one mole of the silver halide.

In the present invention, it is preferable to use compounds disclosed in JP-A-2-157749, page 13, lower right column to page 22, lower right column when a sensitizing dye having spectral sensitization in the red and infrared regions is used. To use these compounds improves significantly the storability of the photosensitive material, stability of processing, and strong color sensitizing effects. Of these, the compounds represented by general formulae (IV), (V), and (VI) in JP-A-2-157749 are used along with the red-and-infrared sensitizing dye. An amount of the compound used is preferably in a range from $0.5\times10^{-5}$ to $5.0\times10^{-2}$ moles, and more preferably from $5.0\times10^{-5}$ to $5.0\times10^{-3}$ moles per one mole of the silver halide. An effective amount of usage lies in a range from 0.1 to 10,000 times, and more preferably from 0.5 to 5,000 times as much as 1 mole of the sensitizing dye.

The photosensitive material according to the present invention has found its application in the field of digital scan/exposure using monochromatic high-density light such as gas laser, light emitting diodes, semiconductor laser, second harmonic wave generating (SHG) light sources having a combination of a non-linear optical crystal and semiconductor laser or solid state laser with an excitation light source of semiconductor laser as well as in printing systems using common negative printers. It is preferable to use the semiconductor laser, or the second harmonic wave generating light source having a combination of the non-linear optical crystal and the semiconductor or solid state laser by the consideration of providing a compact and economical system. It is preferable to use semiconductor laser in order to design a particularly small, economical, and high-stable machine having a long lifetime. It is also preferable to use semiconductor laser for at least one of exposure light sources.

The spectral sensitization maximum of the photosensitive material according to the present invention can be determined arbitrary depending on wavelengths obtained in a light source used for scan exposure when the light sources of the type described is used. Blue and green light can be obtained with the SHG light source comprising a combination of the non-linear optical crystal and the semiconductor laser or the solid state laser having the excitation light source formed of the semiconductor laser because an oscillation wavelength of the laser can be halved. Accordingly, it becomes possible to achieve the spectral sensitization maximum of the photosensitive material in the normal blue, green, and red ranges of the spectrum. It is preferable that at least two layers have the spectral sensitization maximum in the range of 670 nm or higher to provide a small, economical, and high-stable machine with the semiconductor laser used as the light source. This is because economical and stable III-V semiconductor laser currently available can only emit light having wavelengths of red and infrared regions. However, oscillation of II-VI semiconductor laser has been observed in a laboratory level and it is thus expected that such laser will be used economically and stably after a probable development of techniques for producing semiconductor laser. In this event, there will be less necessity of ensuring that at least two layers have the spectral sensitization maximum in the range of 670 nm or higher.

With such scan exposure, an exposure time for the silver halide in the photosensitive material corresponds to that required for exposing a certain small area. This small area is typically a smallest unit (called "pixel") of controlling an amount of light based on individual digital data. Accordingly, the exposure time required for exposing one pixel depends on the size of the individual pixels. The size of the pixel varies according to the image density, of which practical size is in a range from 50 to 2,000 dot per inch (dpi). The exposure time is preferably $10^{-4}$ seconds or shorter, and more preferably $10^{-6}$ seconds or shorter with the image density of 400 dpi.

In the photosensitive material according to the present invention, it is preferable to add dyes adapted to be decolored by photographic processing (oxonol dyes or cyanine dyes), disclosed in European Patent Publication No. 0,337,490A2, pages 27–76, to a hydrophilic colloidal layer to avoid irradiation or halation and to improve safelight immunity.

Some of these water-soluble dyes badly affect color separation and the safelight immunity when the amount used is increased. Preferable dyes applicable without deteriorating the color separation are those disclosed in Japanese Patent Application Nos. 3-310143, 3-310189, and 3-310139.

In the present invention, a colored layer adapted to be decolored by photographic processing is used in place of or along with the water-soluble dyes. The colored layer used adapted to be decolored by photographic processing may contact directly with the emulsion layer. Alternatively, the colored layer may be separated from the emulsion layer by an interlayer containing a processing color amalgamation inhibiting agent such as hydroquinone and gelatin. The colored layer is preferably formed under (support side) the emulsion layer developing a primary color of the same group as the color of the colored layer. Colored layers may be formed for the respective primary colors or may be formed only for selected one or more of the primary colors. The colored layer may be colored for two or more primary color regions. An optical reflection density of the colored layer(s) is preferably in a range from 0.2 to 0.3, both inclusive, more preferably from 0.5 to 2.5, both inclusive, and most preferably from 0.8 to 2.0, both inclusive, at the wavelength with the highest reflection density in the wavelengths used for exposure (visible spectrum of from 400 to 700 nm for normal printer exposure, and wavelengths of the scan/exposure light source used for scan exposure).

The colored layer may be formed through any one of known methods. For example, dyes may be dispersed in the hydrophilic colloid layer in a form of solid fine particle dispersion as dyes disclosed in JP-A-2-282244, page 3, upper right column to page 8, and those disclosed in JP-A-3-7931, page 3, upper right column to page 11, lower left column. Anion dyes may be mordated in a cation polymer. Dyes may be adsorbed on fine grains of, for example, silver halide and fixed in the layer. In addition, colloidal silver as disclosed in JP-A-1-239544 may be used. A method of dispersing the fine powder of the dye in the solid state is disclosed in, for example, JP-A-2-308244, pages 4 to 13, in which fine powder of the dyes is contained in the colloid layer which are substantially insoluble to water at pH of at least 6 or lower white are substantially soluble to water at pH of at least 8 or higher. A method of mordating the anion dyes in the cation polymer is disclosed in, for example, JP-A-2-84637, pages 18 to 26. Methods of preparing the colloidal silver which serves as a light absorber are disclosed in U.S. Pat. Nos. 2,688,601, and 3,459,563. Of these methods, preferable ones are methods of containing fine powder of dyes and of using the colloidal silver.

The photosensitive material according to the present invention comprises a binder (a protective colloid). The gelatin can be used advantageously as the binder. Other hydrophilic colloids may also be used alone or along with the gelatin. The gelatin may be a low calcium gelatin preferably having a calcium content of 800 ppm or lower, and more preferably of 200 ppm or lower. In addition, it is preferable to add mildew proofing agents as disclosed in JP-A-63-271247 to the photosensitive material according to the present invention so as to eliminate the problem of mildew, or bacteria growing in the hydrophilic colloidal layer, which otherwise may be a cause of image deterioration.

In exposing the photosensitive material of the present invention by using a printer, a band stop filter disclosed in U.S. Pat. No. 4,880,726 may advantageously be used in exposure. This eliminates light color amalgamation, resulting in remarkable improvement of color reproducibility.

In addition, the silver halide color photographic photosensitive material according to the present invention is preferably exposed through a color negative film having a transparent magnetic recording layer as disclosed in, for example, JP-A-4-62543 and U.S. Pat. No. 5,147,768, which is incorporated hereinto by a reference, and then subjected to color development processing.

The exposed photosensitive material is subjected to common color development processing. In this event, the photosensitive material according to the present invention is preferably subjected to bleach-fixing process after color development to achieve rapid processing. In particular, when the above mentioned high silver chloride emulsion is used, pH of a bleach-fixing solution is preferably not larger than 6.5, and more preferably not larger than 6 to enhance removal of silver.

Those disclosed in the published Japanese patent applications and the European Pat. Publication No. 0,355,660 (JP-A-2-139544) are preferable examples of the silver halide emulsion, other materials (additives), photograph forming layers (layer structure or the like), and the methods and the processing additives applied to process the photosensitive material.

TABLE 1

| PHOTOGRAPH COMPONENTS | JP-A-62-215272 | JP-A-2-33144 | EP 355660 A2 |
|---|---|---|---|
| Silver Halide Emulsion | p.10, l.6 of URC to p.12, l.5 of LLC; and p.12, 4th line from bottom of LRC to p.13 l.17 of ULC | p.28, l.16 of URC to p.29, l.11 of LRC; and p.30, ll.2–5 | p.45, l.53 to p.47 l.3; and p.47, ll.20–22 |
| Silver Halide Solvent | p.12, ll.6–14 of LLC and p.13, 3rd line from bottom of ULC to p.18, last line of LLC | — | — |
| Chemical Sensitizer | p.12, 3rd line from bottom of LLC to 5th line from bottom of LRC; and p.18, l.1 of LRC to p.22, 9th line from bottom of URC | p.29, ll.12 to last line of LRC | p.47, ll.4–9 |
| Spectral Sensitizer (Spectral Sensitization) | p.22, 8th line from bottom of URC to p.38, last line | p.30, ll.1–13 of ULC | p.47, ll.10–15 |
| Emulsion Stabilizer | p.39, l.1 of ULC to p.72, last line of URC | p.30, l.14 of ULC to l.1 of URC | p.47, ll.16–19 |
| Development Accelerator | p.72, l.1 of LLC to p.91, l.3 of URC | — | — |

*ULC = upper left column; URC = upper right column; LLC = lower left column; LRC = lower right column

TABLE 2

| PHOTOGRAPH COMPONENTS | JP-A-62-215272 | JP-A-2-33144 | EP 355660 A2 |
|---|---|---|---|
| Color Couplers (Cyan, Magenta, Yellow Couplers) | p.91 l.4 of URC to p.121, l.6 of ULC | p.3, l.14 of URC to p.18, last line of ULC; and p.30, l.6 of URC to p.35, l.11 of LRC | p.4, ll.15–27; p.5, l.30 to p.28, last line; p.45, ll.29–31; and p.47, l.23 to p.63, l.50 |
| Color Generation Accelerator | p.121, l.7 of ULC to p.125, l.1 of URC | — | — |
| Ultraviolet Light Absorbing Agent | p.125, l.2 of URC to p.127, last line of LLC | p.37, l.14 of LRC to p.38, l.11 of ULC | p.65, ll.22–31 |
| Anti-fading Agent (Image Stabilizer) | p.127, l.1 of LRC to p.137, l.8 of LLC | p.36, l.12 of URC to p.37, l.19 of ULC | p.4, l.30 to p.5, l.23; p.29, l.1 to p.45, l.25; p.45, ll.33–40; and p.65, ll.2–21 |
| High-boiling and/or Low-boiling Organic Solvent | p.137, l.9 of LLC to p.144, last line of URC | p.35, l.14 of LRC to p.36, 4th line from bottom of ULC | p.64, ll.1–51 |
| Dispersion Methods for Photographing Additives | p.144, l.1 of LLC to p.146, l.7 of URC | p.27, l.10 of LRC to p.28, last line of ULC; and p.35, l.12 of LRC to p.36, l.7 of URC | p.63, l.51 to p.64, l.56 |

TABLE 3

| PHOTOGRAPH COMPONENTS | JP-A-62-215272 | JP-2-33144 | EP 355660 A2 |
|---|---|---|---|
| Hardening Agent | p.146 l.8 of URC to p. 155, l.4 of LLC | — | — |
| Developing Agent Precursor | p.155, l.5 of LLC to p.155, l.2 of LRC | — | — |
| Development Inhibitor Releasing Compound | p.155, ll.3–9 of LRC | — | — |
| Support | p. 155, l.19 of LRC to p.156, l.14 of ULC | p.38, l.18 of URC to p.39, l.3 of ULC | p.66, l.29 to p.67, l.13 |

TABLE 3-continued

| PHOTOGRAPH COMPONENTS | JP-A-62-215272 | JP-2-33144 | EP 355660 A2 |
|---|---|---|---|
| Photosensitive material Layer Structure | p.156, l.15 of ULC to p.156, l.14 of LRC | p.28, ll.1–15 of URC | p.45, ll.41–52 |
| Dye | p.156, l.15 of LRC to p.184, last line of LRC | p.38, l.12 of ULC to l.7 of URC | p.66, ll.18–22 |
| Color Mixing Inhibitor | p.185, l.1 of ULC to p.188, l.3 of LRC | p.36, ll.8–11 of URC | p.64, l.57 to p.65, l.1 |
| Gradation Adjusting Agent | p.188, ll.4–8 of LRC | — | — |

TABLE 4

| PHOTOGRAPH COMPONENTS | JP-A-62-215272 | JP-A-2-33144 | EP 355660 A2 |
|---|---|---|---|
| Stain Inhibitor | p.188, l.9 of LRC to p.193, l.10 of LRC | p.37, last line of ULC to l.13 of LRC | p.65, l.32 to p.66, l.17 |
| Surfactant | p.201, l.1 of LLC to p.210, last line of URC | p.18, l.1 of URC to p.24, last line of LRC; and p.27, 10th line from bottom of LLC to l.9 of LRC | — |
| Fluorine-containing Compound (antistatic agent, coating aid, lubricant, adhesion inhibitor) | p.210, l.1 of LLC to p.222, l.5 of LLC | p.25, l.1 of ULC to p.27, l.9 of LRC | — |
| Binder (hydrophilic colloid) | p.222, l.6 of LLC to p.225, last line of ULC | p.38, ll.8–18 of URC | p.66, ll.23–28 |
| Thickening Agent | p.225, l.1 of URC to p.227, l.2 of URC | — | — |
| Antistatic Agent | p.227, l.3 of URC to p.230, l.1 of ULC | — | — |

TABLE 5

| PHOTOGRAPH COMPONENTS | JP-A-62-215272 | JP-A-2-33144 | EP 355660 A2 |
|---|---|---|---|
| Polymer Latex | p.230, l.2 of ULC to p.239, last line | — | — |
| Matte Agent | p.240, l.1 of ULC to p.240, last line of URC | — | — |
| Photographic Processing Methods (process and additives) | p.3, l.7 of URC to p.10, l.5 of URC. | p.39, l.4 of ULC to p.42, last line of ULC | p.67, l.14 to p.69, l.28 |

NOTE:
Citations from JP-A-62-215272 include the amended contents in the Amendment of March 16, 1987, printed at the end of this publication.
Also for the color couplers, it is preferable to use as the yellow coupler a so-called short-wave type yellow coupler disclosed in JP-A-63-231451, JP-A-63-123047, JP-A-63-241547, JP-A-1-173499, JP-A-1-213648 and JP-A-1-250944.

The cyan, magenta or yellow coupler may be emulsified and dispersed in a hydrophilic colloidal solution by means of impregnating in a loadable latex polymer (e.g., U.S. Pat. No. 4,203,716) in the presence (or absence) of the above mentioned high-boiling organic solvent given in the above table, or alternatively, by means of dissolving together with a water insoluble and organic-solvent soluble polymer. Examples of the water insoluble and organic-solvent soluble polymer used preferably include homopolymers or copolymers as those disclosed in U.S. Pat. No. 4,856,449, columns 7 to 15 and International Pat. Publication No. WO 88/00723, pages 12–30. It is particularly preferable to use a methacrylate or acrylamide polymer, especially the acrylamide polymer by the consideration of color image stability. In addition, it is also preferable to use a polymer disclosed in JP-A-5-66533.

It is preferable to use together with the couplers a color image storability improving compounds such as those disclosed in European Pat. Publication No. 0,277,589A2. In particular, such improving compounds may be advantageously used with pyrazoloazole couplers or pyrroloazole couplers.

More specifically, it is preferable, for preventing any adverse effects such as staining because of color generating dyes formed as a result of a reaction of the couplers with color developing agents left in the layer or oxidants thereof during storage after processing, to use single or a combination of compounds disclosed in the above patent which are capable of chemically bonding to the aromatic amine developing agents left after color developing processing, thereby producing substantially colorless and chemically inactive compounds and/or compounds disclosed in the above patent which are capable of chemically bonding to the oxidants of the aromatic amine developing agents left after color developing processing, thereby producing substantially colorless and chemically inactive compounds.

As the cyan coupler, other than diphenylimidazole cyan couplers disclosed in JP-A-2-33144, advantageously used are 3-hydroxypyridine cyan couplers disclosed in European Patent Publication No. 0,333,185 (in particular, preferable are a 2-equivalent coupler produced by means of adding a chloride removal group to a 4-equivalent coupler of a coupler (42) and couplers (6) and (9) disclosed as specific examples); cyclic active methylene cyan couplers disclosed in JP-A-64-32260 (in particular, couplers 3, 8 and 34 disclosed as specific examples are preferable); pyrrolopyrazole cyan couplers disclosed in European Patent Publication No. 0,456,226A1; pyrroloimidazole cyan couplers disclosed in European Patent No. 0,484,909; and pyrrolotriazole cyan couplers disclosed in European Patent No. 0,488,248 and European Patent Publication No. 0,491,197A1. Of these, the pyrrolotriazole cyan couplers are significantly preferable.

As the yellow coupler, other than the compounds set forth in the above Tables, advantageously used are acylacetoamide yellow couplers having a 3- to 5-membered ring structure at an acyl group disclosed in European Patent Publication No. 0,447,969A1; malondianilide yellow coupler having a ring structure disclosed in European Patent Publication No. 0,482,552A1; and acylacetoamide yellow couplers having a dioxane structure disclosed in U.S. Pat. No. 5,118,599. Of these, it is preferable to use acylacetoamide yellow couplers of which acyl group is 1-alkylcyclopropane-1-carbonyl group, and malondianilide yellow coupler in which one of anilides form an indoline ring. These couplers may be used solely or as a combination of two or more.

The magenta coupler used in the present invention may be 5-pyrazolone magenta couplers or pyrazoloazole magenta couplers disclosed in the articles set forth in the above Tables. Of these, advantageously used by the considerations of hues, image stability and color generation stability are pyrazolotriazole couplers disclosed in JP-A-61-65245 in which a secondary or tertiary alkyl group is directly bonded to a 2-, 3- or 6-coordinate of a pyrazolotriazole ring; pyrazoloazole couplers containing sulfamides in molecules disclosed in JP-A-61-65246; pyrazoloazole couplers having an alkoxyphenylsulfamideparasod disclosed in JP-A-61-147254; and pyrazoloazole couplers having an alkoxy group or an aryloxy group at a 6-coordinate disclosed in European Patent No. 226,849A.

As the color photosensitive material according to the present invention, other than those disclosed in the above Tables, preferable processing materials and processing methods are disclosed in JP-A-2-207250, page 26, lower right column, line 1 to page 34, upper right column, line 9; and JP-A-4-97355, page 5, upper left column, line 17 to page 18, lower right column, line 20.

The color developers used in the present invention preferably contain organic preservatives rather than hydroxylamine or sulfite ions.

The term "organic preservatives" used herein means any organic compounds having capabilities of reducing deterioration rate of the aromatic primary amine color developing agent when added to the processing solution for the color photographic photosensitive material. More specifically, the organic preservatives may be organic compounds having functions of avoiding oxidation of the color developing agent due to air or the like. Of these, particularly effective organic preservatives include hydroxylamine derivatives (except for hydroxylamine), hydroxamic acids, hydrazines, hydrazides, α-amino acids, phenols, α-hydroxyketones, α-aminoketones, sugars, monoamines, diamines, polyamines, quaternary ammonium salts, nitroxy radicals, alcohols, oximes, diamide compounds and condensed ring amines. These are disclosed in, for example, JP-B-48-30496 (the term "JP-B" as used herein means an "examined" Japanese patent publication), JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-1-97953, JP-A-1-186939, JP-A-1-186940, JP-A-1-187557, JP-A-2-306244, and European Patent Publication No. 0,530,921A1. In addition, as the preservatives, various metals disclosed in JP-A-57-44148 and JP-A-57-53749; salicylic acids disclosed in JP-A-59-180588; amines disclosed in JP-A-63-239447, JP-A-63-128340, JP-A-1-186939 and JP-A-1-187557; alkanolamines disclosed in JP-A-54-3532; polyethyleneimines disclosed in JP-A-56-94349; and aromatic polyhydroxy compounds disclosed in U.S. Pat. No. 3,746,544 may be used if necessary. In particular, it is preferable to add following compounds: alkanolamines such as triethanolamine, dialkylhydroxylamine such as N,N-diethylhydroxylamine and N,N-di(sulfoethyl)hydroxylamine, α-amino acid derivatives such as glycine, alanine, leucine, serine, threonine, valine, isoleucine and aromatic polyhydroxy compounds such as catechol-3,5-disulfonyl soda.

In particular, to use dialkylhydroxylamine together with alkanolamines, or to use dialkylhydroxylamine disclosed in European Patent Publication No. 0,530,921A1 together with alkanolamines and α-amino acids (such as glycine) is preferable in view of improving stability of the color developer and improving stability in a continuous processing accordingly.

An amount of the preservatives added may be any one of suitable amounts for exhibiting functions of avoiding degradation of the color developing agents. The amount is preferably from 0.01 to 1.0 mole per liter, and more preferably from 0.03 to 0.30 moles per liter.

The present invention will be more readily apparent in the context of a specifically delineated set of examples and a reference. However, it should be understood that the present invention is not limited to those particular examples.

EXAMPLE 1

(Preparation of Emulsion)

32 g of a lime-treated gelatin was added to 800 ml of distilled water and dissolved at 40° C., to which 5.76 g of sodium chloride was added and the temperature was increased to 55° C. 1.0 ml of N,N'-dimethylimidazolidine-2-thion (1%-solution) was added to the solution. A solution of 100 g of silver nitrate dissolved in 400 ml of distilled water and a solution of 34.4 g of sodium chloride dissolved in 400 ml of distilled water were added to and mixed with the resultant solution for 35 minutes at the constant temperature of 55° C. Subsequently, a solution of 59.2 g of silver nitrate dissolved in 200 ml of distilled water and a solution of 17.1 g of sodium chloride dissolved in 200 ml of distilled water were added to the resultant solution over 18 minutes at the constant temperature of 55° C. while the solution was mixed. The temperature was reduced to 40° C. and then a green-sensitive sensitizing dye G given below and a sensitizing dye D were added to the solution in amounts of $4\times10^{-4}$ moles and $7\times10^{-5}$ moles, respectively, per one mole of the silver halide. Subsequently, a solution of 0.8 g of silver nitrate dissolved in 100 ml of distilled water and a solution of 0.56 g of potassium bromide dissolved in 100 ml of distilled water were added to the resultant solution over 10 minutes at the constant temperature of 40° C. while the solution was mixed. The resultant solution was subjected to desalting and rinsing, to which 90 g of lime-treated gelatin was added. In addition, pAg and pH were adjusted to 7.3 and 6.2, respectively, with sodium chloride and sodium hydroxide. The temperature was increased to 50° C. and a following sulfur sensitizer was added for optimum sulfur sensitization. A silver chlorobromide emulsion A (containing 0.5% by mole of silver bromide) was thus prepared.

A silver chlorobromide emulsion B was prepared in the same manner as the silver chlorobromide emulsion A except that a following selenium sensitizer was used in place of the sulfur sensitizer for optimum selenium sensitization.

A silver chlorobromide emulsion C was prepared in the same manner as the silver chlorobromide emulsion A except that a following tellurium sensitizer was used in place of the sulfur sensitizer for optimum tellurium sensitization.

A silver chlorobromide emulsion D was prepared in the same manner as the silver chlorobromide emulsion A except that chloroauric acid was used in place of the sulfur sensitizer for optimum gold sensitization.

A silver chlorobromide emulsion E was prepared in the same manner as the silver chlorobromide emulsion A except that chloroauric acid was used along with the sulfur sensitizer for optimum gold/sulfur sensitization.

As the green-sensitive sensitizing dye and the chemical sensitizer, following compounds were used.

TABLE 6

GREEN-SENSITIVE SENSITIZING DYE

SENSITIZING DYE G

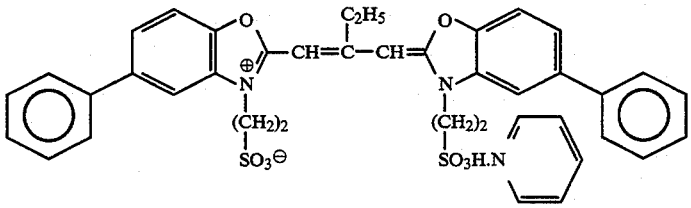

SENSITIZING DYE D

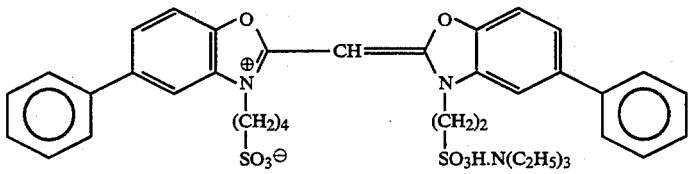

SULFUR SENSITIZER

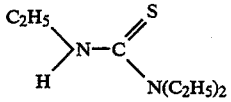

SELENIUM SENSITIZER

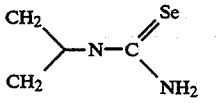

TELLURIUM SENSITIZER

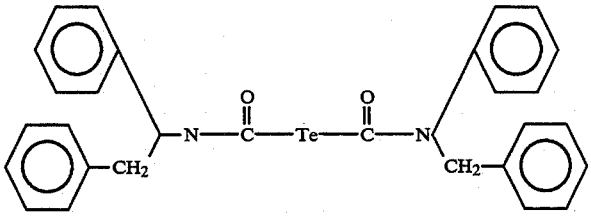

A shape of the grains, a grain size and a grain size distribution were obtained based on electron microphotographs for the emulsions A through E so prepared. The grain size was given by an average diameter of circles each having an area that is equal to the projection area. The grain size distribution was given as a value obtained by means of dividing a standard deviation of the grain diameter by an average grain size. The emulsions A through E are all cubic grains having the grain size of 0.42 μm and a fluctuation coefficient of grain size distribution of 0.10.

(Production of Base Paper)

A wood pulp mixture (LBKP/NBSP=2/1) was beaten to obtain a slurry of 250 ml of Canadian Standard Freeness (CSF). Subsequently, the pulp slurry was diluted with water, to which added were 1.0% (relative to pulp) of anionic polyacrylamide (Polystron 195 produced by Arakawa Chemical Industries Ltd.; molecular weight approximately 1,100,000), 1.0% (relative to pulp) of aluminum sulfate, and 0.15% (relative to pulp) of polyamide-polyamine epichlorohydrin (Kymene 557 produced by Hercules Inc.). In addition, epoxidized behenic acid amide and alkyl ketene dimer (compound having an alkyl group $C_{20}H_{41}$), each 0.4% by weight relative to pulp, were added to the mixture. Sodium hydroxide was then added to adjust pH to 7. Further, 0.5% (relative to pulp) of cationic polyacrylamide and 0.1% (relative to pulp) of anti-foaming agent were added to the resultant mixture. With the slurry so prepared, a base paper of 180 g/m$^2$ in basis weight was made.

The base paper was dried in an oven to reduce the moisture content to approximately 2 percent. After drying, a surface sizing agent (aqueous solution) having the following composition was subjected to a size press to improve surface bonding on the side of the base paper to be coated with a photographic emulsion such that 20 g/m$^2$ of the solution was bonded thereto.

| Composition of the Surface Sizing Agent | |
|---|---|
| Polyvinyl Alcohol | 4% |
| Calcium Chloride | 4% |
| Fluorescent Whitening Agent | 0.5% |

-continued

| Composition of the Surface Sizing Agent | |
|---|---|
| Anti-foaming Agent | 0.005% |

Wood pulp consisting of 70 parts of LBKP (hardwood bleached kraft pulp) and 30 parts of LBSP was mechanically beaten in a disc refiner into 290 ml of CSF. Neutral sizing agents, i.e., 1.0 part of alkyl ketene dimer (Aquapel I2 produced by Hercules Inc.), 1.0 part of anionic polyacrylamide (Polystron 194-7 produced by Arakawa Chemical Industries Ltd.), 0.5 parts of cationic polyacrylamide (Polystron 705 produced by Arakawa Chemical Industries Ltd.), and 0.3 parts of polyamide-polyamine epichlorohydrin (Kymene 557 produced by Hercules Inc.), each by oven-dry weight to pulp, were then added to the resultant pulp slurry. The slurry was fed into a fourdrinier paper machine to form a base paper of 170 g/m$^2$ in basis weight and 165 μm in thickness. A base paper (A) was so formed.

A pH value of the base paper (A) was 6.4 when measured through the hot water extraction according to JIS P 8133.

Neutral sizing agents, i.e., 0.6 parts of epoxidized fatty amide (NS-715 produced by Kindai Chemical Industries Co., Ltd.), 1.2 parts of anionic polyacrylamide (Polystron 194-7 produced by Arakawa Chemical Industries Ltd.), 1.0 part of aluminum sulfate, 0.9 parts of NaOH, and 1.0 part of cationic starch, each by oven-dry weight ratio to pulp, were added to the same beaten pulp as used for the base paper (A).

Next, a base paper (B) of 170 g/m$^2$ in basis weight and 165 μm in thickness was formed in the same manner as those described above. A pH value of the base paper (B) was 7.3.

1.0 part of sodium stearate, 1.0 part of anionic polyacrylamide (Polystron 194-7 produced by Arakawa Chemical Industries Ltd.), and 1.5 parts of aluminum sulfate, each by oven-dry weight ratio to pulp, were added to the same beaten pulp as used for the base paper (A). Next, a base paper (C) of 170 g/m$^2$ in basis weight and 165 μm in thickness was formed in the same manner as those described above.

A pH value measured through the hot water extraction was 3.8.

A base paper (D) was formed in the same manner as for the base paper (C) except that 0.5 parts of sodium alminate was added after addition of aluminum sulfate.

A pH value measured through the hot water extraction was 4.7.

Base papers (E) and (F) having pH 7.8 and pH 8.5, respectively, were formed with a varied amount of NaOH added.

(Production of Support)

Titanium dioxide was added to low-density polyethylene (MRF=3) in the amount set forth in Table 7 below. In addition, 3.0% by weight of zinc stearate relative to the titanium dioxide was contained in the mixture, which was kneaded along with ultramarine blue dye (DV-1 prepared by Daiichi Kasei Kogyo Co., Ltd.) in a Banbury mixer. The resultant compound was formed into a pellet as a master batch. A particle size of the titanium dioxide was 0.15–0.35 μm according to an electron microphotograph. A coating amount of hydroua aluminum oxide in the form of $Al_2O_3$ was 0.7% by weight relative to the titanium dioxide.

The above mentioned base papers were treated with the corona discharge at 10 kVA and then melt extruded at 320° C. by using a multi-layer extrusion coating die to form a polyethylene laminate layer having a film thickness set forth in Table 7. The surface of the polyethylene layer was treated with the glow discharge.

TABLE 7

| Coating Layer | Uppermost Layer (Layer at emulsion layer side) $TiO_2$ Content (wt. %) | Uppermost Layer Film Thickness (μm) | Interlayer $TiO_2$ Content (wt. %) | Interlayer Film Thickness (μm) | Lowermost Layer (Layer at base-paper side) $TiO_2$ Content (wt. %) | Lowermost Layer Film Thickness (μm) | Total Amount of $TiO_2$ (g/m$^2$) |
|---|---|---|---|---|---|---|---|
| A | 21 | 30 | — | — | — | — | 6.9 |
| B | 25 | 15 | — | — | 15 | 15 | 6.7 |
| C | 35 | 15 | — | — | 0 | 15 | 6.7 |
| D | 10 | 2 | 35 | 15 | 0 | 13 | 6.9 |

Various photographic structural layers were applied to the support so produced to make a multilayer color photographic printing paper having the layer structure as set forth below. Coating solutions were prepared in the manner described below.

Preparation of First Layer Coating Solution 153 g of a yellow coupler (ExY), 15.0 g of a color image stabilizer (Cpd-1), 7.5 g of a color image stabilizer (Cpd-2), and 16.0 g of a color image stabilizer (Cpd-3) were dissolved in 25.0 g of a solvent (solv-1), 25.0 g of a solvent (solv-2), and 180 ml of ethyl acetate. The resultant solution was added to 1,000 g of a 10%-gelatin aqueous solution containing 60.0 ml of 10%-sodium dodecylbenzenesulfonate and 10 g of citric acid, so that the solution was emulsified to prepare an emulsified dispersion. In addition, a silver chlorobromide emulsion was also prepared that consists of grains of silver halide dispersed in the dispersion medium. The particles were cubic. The emulsion was a 3:7 mixture (silver molar ratio) of a large-size emulsion and a small-size emulsion. The silver halide dispersed in the large-size and small-size emulsions were 0.88 μm and 0.70 μm, respectively, while fluctuation coefficients of the grain size distribution were 0.08 and 0.1, respectively. In the emulsions, each silver halide particle consisted of 0.3% by mole of silver bromide localized at a portion of the surfaces of the grains. The emulsion was provided with a blue-sensitive dye B as set forth below added thereto at the amount of $2.0\times10^{-4}$ moles and $2.5\times10^{-4}$ moles per 1 mole of silver halide for the large-size and the small-size emulsions, respectively. Chemical aging was performed with additions of sulfur and gold sensitizers. The above mentioned emulsified dispersion and the silver chlorobromide emulsion were mixed and dissolved. Prepared in this way the first layer coating solution has the formulation as set forth below. The coating amount of the emulsion is converted into that of silver.

The method used for preparing the first layer coating was also used to prepare the second through seventh layers. As the gelatin hardening agent, 1-oxy-3,5-dichloro-s-triazine sodium salt was used.

In addition, Cpd-14 and Cpd-15 were added to each layer in the total amounts of 25.0 mg/m$^2$ and 50.0 mg/m$^2$, respectively.

In addition, 1-(5-methylureidophenyl)-5-mercaptotetrazole was added to the blue-, green-, and red-sensitive emulsion layers at $8.5\times10^{-5}$ moles, $7.7\times10^{-4}$ moles, and $2.5\times10^{-4}$ moles, respectively, silver halide.

Further, 4-hydroxy-6-methyl-1,3,3a,7-tetraazaindene was added to the blue-, and green-sensitive emulsion layers at $1\times10^{-4}$ moles, and $2\times10^{-4}$ moles, respectively, per 1 mol of silver halide.

BLUE-SENSITIVE EMULSION LAYER

SENSITIZING DYE A

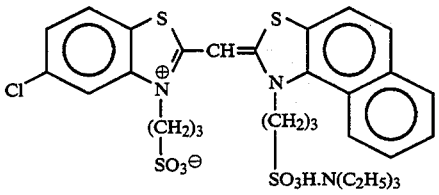

and

SENSITIZING DYE B

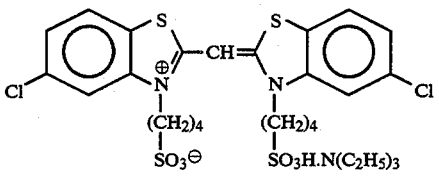

RED-SENSITIZING EMULSION LAYER

SENSITIZING DYE E

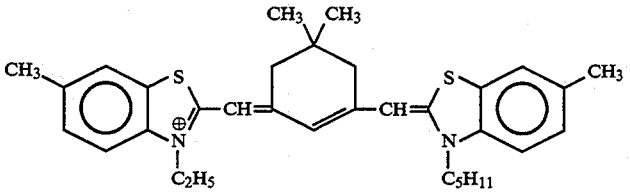

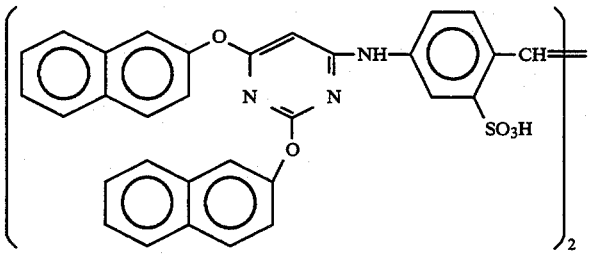

(0.9 × 10$^{-4}$ moles and 1.1 × 10$^{-4}$ moles per 1 mole of silver halide for the large-size and the small-size emulsions, respectively)

In addition, the following compound was added to the red-sensitive emulsion layer in an amount of $2.6\times10^{-5}$ moles per 1 mole of silver halide.

Besides, dyes as set forth below were added to the emulsion layers to avoid irradiation. (The numerals within parentheses identify the amount of the dyes coated.)

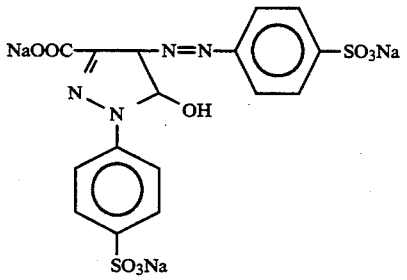

(10 mg/m²)

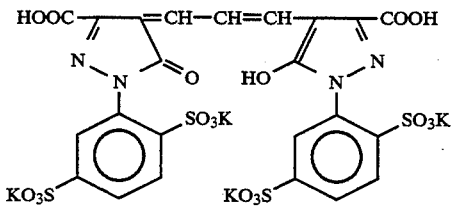

(10 mg/m²)

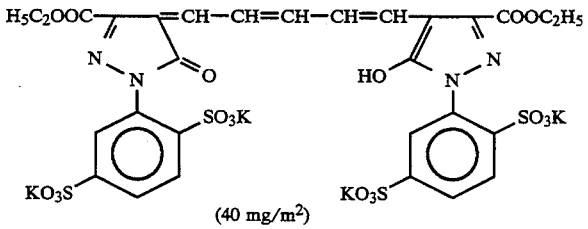

(40 mg/m²)

and

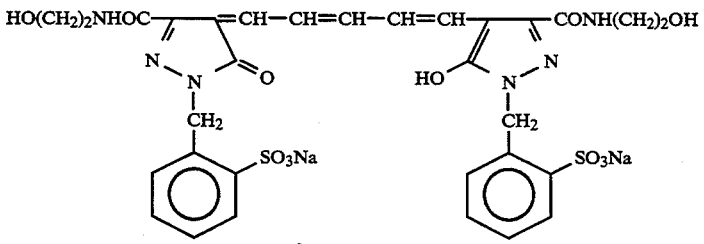

(20 mg/m²)

(LAYER STRUCTURE)

Formulations of the individual layers are set forth below. The numerals identify the coating amount (g/m²). The coating amount of the silver halide emulsion is converted into that of silver.

| | |
|---|---|
| FIRST LAYER (BLUE-SENSITIVE EMULSION LAYER) | |
| Silver Chlorobromide Emulsion | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-l) | 0.13 |
| Solvent (Solv-2) | 0.13 |
| SECOND LAYER (COLOR MIXING INHIBITING LAYER) | |
| Gelatin | 1.00 |
| Color Mixing Inhibitor (Cpd-4) | 0.06 |
| Solvent (Solv-2) | 0.25 |
| Solvent (Solv-3) | 0.25 |
| Solvent (Solv-7) | 0.03 |
| THIRD LAYER (GREEN-SENSITIVE EMULSION LAYER) | |

-continued

| | |
|---|---|
| Silver Chlorobromide Emulsion (See Table 8) | 0.13 |
| Gelatin | 1.45 |
| Magenta Coupler (EXM) | 0.16 |
| Color Image Stabilizer (Cpd-2) | 0.03 |
| Color Image Stabilizer (Cpd-5) | 0.15 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| FOURTH LAYER (COLOR MIXING INHIBITING LAYER) | |
| Gelatin | 0.70 |
| Color Mixing Inhibitor (Cpd-4) | 0.04 |
| Solvent (Solv-2) | 0.18 |
| Solvent (Solv-3) | 0.18 |
| Solvent (Solv-7) | 0.02 |
| FIFTH LAYER (RED-SENSITIVE EMULSION LAYER) | |
| Silver Chlorobromide Emulsion (1:4 mixture (silver molar ratio) of a large-size emulsion and a small-size emulsion having average grain sizes of 0.50 μm and 0.41 μm, respectively. Fluctuation coefficients of the grain size distribution were 0.09 and | 0.20 |

-continued

| | |
|---|---|
| 0.11, respectively. In the emulsions, each silver halide grain consists of 0.8% by mole of silver bromide localized at a portion of surfaces of the grains having silver chloride as the substrate) | |
| Gelatin | 0.85 |
| Cyan Coupler (EXC) | 0.33 |
| Ultraviolet Light Absorbing Agent (UV-2) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-1) | 0.01 |
| Solvent (Solv-6) | 0.22 |

-continued

| | |
|---|---|
| SIXTH LAYER (ULTRAVIOLET LIGHT ABSORBING LAYER) | |
| Gelatin | 0.55 |
| Ultraviolet Light Absorbing Agent (UV-1) | 0.38 |
| Color Image Stabilizer (Cpd-5) | 0.02 |
| Color Image Stabilizer (Cpd-12) | 0.15 |
| SEVENTH LAYER (PROTECTIVE LAYER) | |
| Gelatin | 1.13 |
| Copolymer of Polyvinyl alcohol denatured with acryl (denaturation rate; 17%) | 0.05 |
| Liquid Paraffin | 0.02 |
| Surfactant (Cpd-13) | 0.01 |

The compounds used are set forth below.

(ExY) YELLOW COUPLER

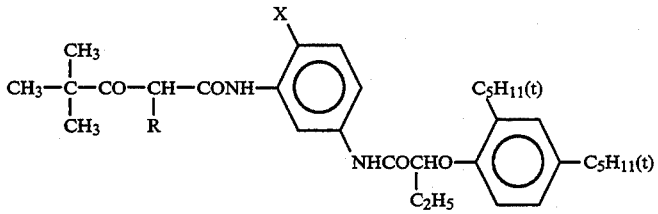

1:1:1 MIXTURE (MOLAR RATIO) OF:

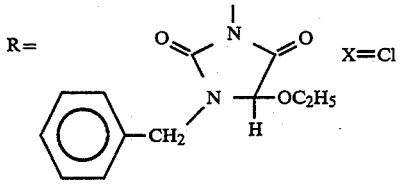

and

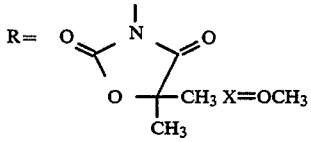

(ExM) MAGENTA COUPLER

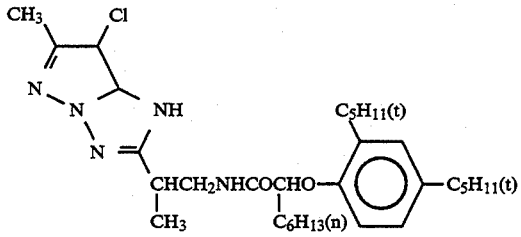

(ExC) CYAN COUPLER

3:7 MIXTURE (MOLAR RATIO) OF:

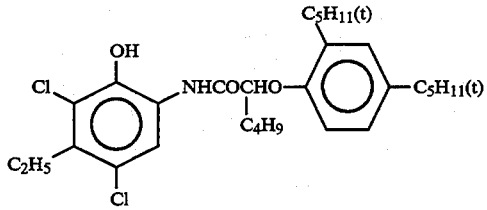

and

-continued
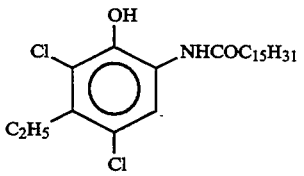
(Cpd-1) COLOR IMAGE STABILIZER
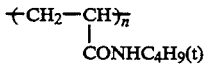
AVERAGE MOLECULAR WEIGHT 60,000
(Cpd-2) COLOR IMAGE STABILIZER
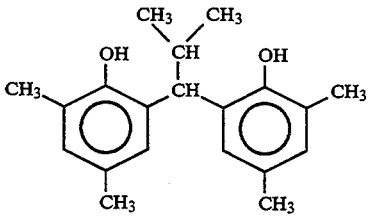
(Cpd-3) COLOR IMAGE STABILIZER
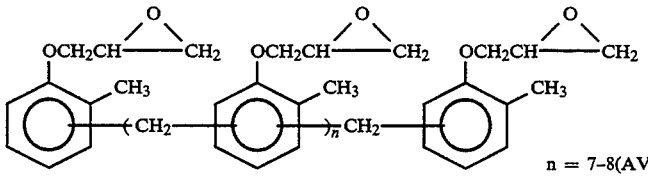
n = 7-8(AVERAGE)
(Cpd-4) COLOR MIXING INHIBITOR
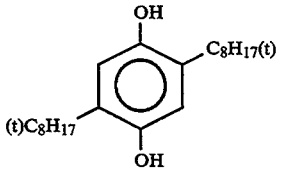
(Cpd-5) COLOR IMAGE STABILIZER
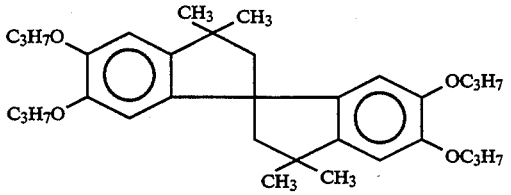
(Cpd-6)
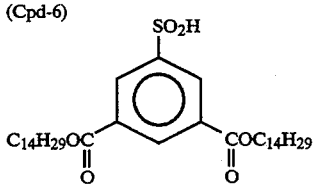
(Cpd-7)
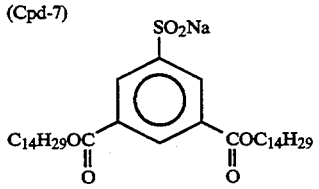

-continued
(Cpd-8) COLOR IMAGE STABILIZER
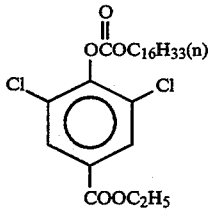
(Cpd-9) COLOR IMAGE STABILIZER
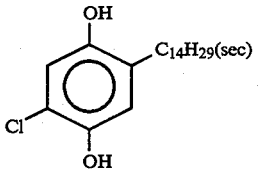
(Cpd-10) COLOR IMAGE STABILIZER
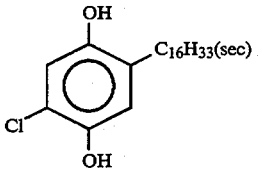
(Cpd-11) COLOR IMAGE STABILIZER
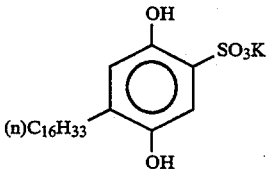
(Cpd-13) SURFACTANT
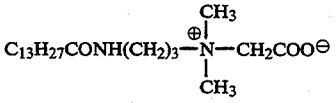
(Cpd-14) ANTISEPTIC
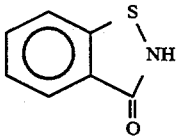
(Cpd-15) ANTISEPTIC
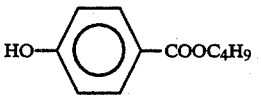
(UV-1) ULTRAVIOLET LIGHT ABSORBING AGENT
1:5:10:5 MIXTURE(WEIGHT RATIO) OF
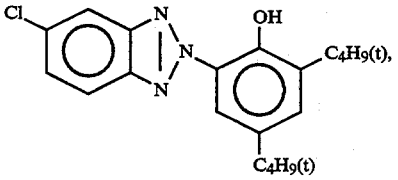

-continued
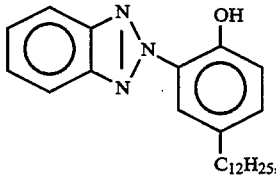
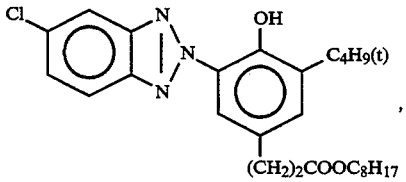
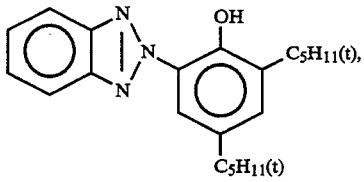
(UV-2)ULTRAVIOLET LIGHT ABSORBING AGENT
1:2:2 MIXTURE (WEIGHT RATIO) OF
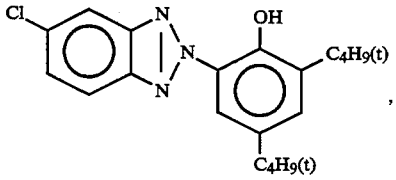
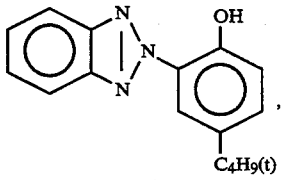
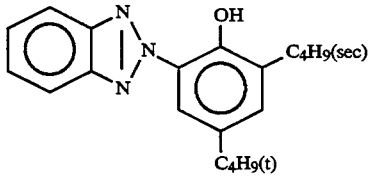
(Solv-1)SOLVENT
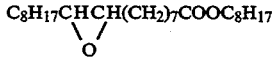
(Solv-2)SOLVENT
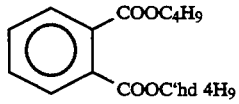
(Solv-3)SOLVENT -continued

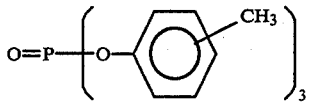

(Solv-4)SOLVENT

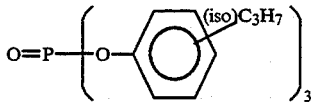

(Solv-5)SOLVENT

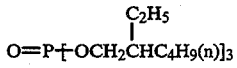

(Solv-6)SOLVENT

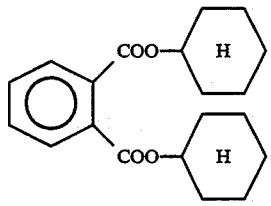

(Solv-7)SOLVENT

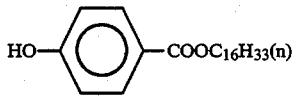

To determine the pressure immunity of the samples so prepared during a long-period storage thereof, each sample was stored in an atmosphere of 30 atm for 2 weeks to make the sample as though it were stored at a normal temperature for a long time. Each sample was folded at an angle of 35° over 1 second on a stainless circular rod of 2 mm in diameter. Thereafter, the samples were subjected to exposure for 1/10 seconds through an optical wedge and a green filter and then subjected to color generating development processing by using following processing process and processing solution. A density of the sample at the folded portion was measured with a micro-densitometer with an exposing degree required for producing a density of 1.8 at a non-folded portion on the processed sample, thereby determining density change (AD) due to folding. In this event, ΔD with a negative value indicates the pressure induced desensitization. The larger the absolute value of ΔD, the higher the degree of the pressure induced desensitization.

To assess the sharpness of the photosensitive material, measure of sharpness was obtained by contact exposure in an optical wedge sensitometer (manufactured by Fuji Photo Film Co., Ltd.) with light filtered by a green filter as the light source. The optical wedge is capable of producing rectangular waves of various patterns, which are provided as inputs to the optical system. To determine the sharpness, a contrast transfer function (CTF) was used. More specifically, a frequency C (number of the rectangular patterns/mm) with the CTF value of 0.5 was obtained as an index for the sharpness. The term "CTF value" used herein means a ratio $\Delta Dc/\Delta D_0$ of the density change, where $\Delta D_0$ represents a density change between high and low density portions when a continuous exposure from high-intensity to low-intensity is effected over a large area at a frequency of 0 with no iteration of the rectangular pattern; and ΔDc represents a similar density change at the frequency C of the rectangular pattern. The larger tha value of C is, the higher the sharpness is.

PROCESSING PROCESS

| Process | Temperature | Time |
|---|---|---|
| Color Development | 35° C. | 45 sec. |
| Bleach-fix | 30–35° C. | 45 sec. |
| Rinse 1 | 30–35° C. | 20 sec. |
| Rinse 2 | 30–35° C. | 20 sec. |
| Rinse 3 | 30–35° C. | 20 sec. |
| Drying | 70–80° C. | 60 sec. |

Formulation of the processing solutions are as follows:

| [Color Developer] | |
|---|---|
| Water | 800 ml |
| Ethylenediamine-N,N,N-N-tetramethylenephosphonic acid | 1.5 g |
| Potassium bromide | 0.015 g |
| Triethanolamine | 8.0 g |
| Sodium Chloride | 1.4 g |
| Potassium Carbonate | 25.0 g |
| N-ethyl-N-(β-methanesulfonamideethyl)-3-methyl-4-aminoaniline sulfate | 5.0 g |
| N,N-bis(carboxymethyl)hydradine | |
| N,N-di(sulfoethyl)hydroxylamine.1Na | 4.0 g |

-continued

| | |
|---|---|
| Fluorescent Whitening Agent (WHITEX 4B, Sumitomo Chemical Co., Ltd.) | 1.0 g |
| Total (with added water) | 1000 ml |
| pH (25° C.) | 10.05 |
| [Bleach-fixing Solution] | |
| Water | 400 ml |
| Ammonium Thiosulfate (70%) | 100 ml |
| Sodium Sulfite | 17 g |
| Ethylenediaminetetraacetato Ferrite (III) Ammonium | 55 g |
| Ferrous Disodium Ethylenediamine Tetra acetate | 5 g |
| Ammonium Bromide | 40 g |
| Total (with added water) | 1000 ml |
| pH (25° C.) | 6.0 |

[Rinse Solution]

Ion Exchange Water (calcium and magnesium are each not higher than 3 ppm)

The results are given in Table 8.

TABLE 8

| Sample No. | Base Paper (pH) | Coating Layer | Emulsion for Green-sensitive Emulsion Layer (Chemical Sensitization) | Sharpness (number/mm) | Pressure Induced Density Change after Aging (ΔD) | Remarks |
|---|---|---|---|---|---|---|
| 1 | C(3.8) | A | A(S) | 9 | −0.5 | Comp. |
| 2 | " | " | B(Se) | " | −0.4 | " |
| 3 | " | " | C(Te) | " | −0.4 | " |
| 4 | " | " | D(Au) | " | −0.5 | " |
| 5 | " | " | E(S/Au) | " | −0.5 | " |
| 6 | " | C | A(S) | 17 | −1.2 | " |
| 7 | " | " | B(Se) | " | −1.2 | " |
| 8 | " | " | C(Te) | " | −1.1 | " |
| 9 | " | " | D(Au) | " | −1.2 | " |
| 10 | " | " | E(A/Su) | " | −1.2 | " |
| 11 | A(6.4) | A | A(S) | 9 | −0.5 | Comp. |
| 12 | " | " | B(Se) | " | −0.5 | " |
| 13 | " | " | C(Te) | " | −0.4 | " |
| 14 | " | " | D(Au) | " | −0.5 | " |
| 15 | " | " | E(S/Au) | " | −0.5 | " |
| 16 | " | C | A(S) | 17 | −1.1 | " |
| 17 | " | " | B(Se) | " | −0.3 | Inv. |
| 18 | " | " | C(Te) | " | −0.2 | " |
| 19 | " | " | D(Au) | " | −0.2 | " |
| 20 | " | " | E(S/Au) | " | −0.4 | " |
| 21 | D(4.7) | A | A(S) | 9 | −0.5 | Comp. |
| 22 | " | " | C(Te) | " | −0.5 | " |
| 23 | " | C | A(S) | 17 | −1.1 | " |
| 24 | " | " | C(Te) | " | −1.0 | " |
| 25 | B(7.3) | A | A(S) | 9 | −0.4 | " |
| 26 | " | " | D(Au) | " | −0.4 | " |
| 27 | " | B | A(S) | 13 | −0.9 | " |
| 28 | " | " | D(Au) | " | −0.2 | Inv. |
| 29 | " | C | A(S) | 17 | −1.0 | Comp. |
| 30 | B(7.3) | " | E(S/Au) | " | −0.3 | Inv. |
| 31 | B(7.3) | D | A(S) | 16 | −1.1 | Comp. |
| 32 | " | " | E(S/Au) | " | −0.2 | Inv. |
| 33 | E(7.8) | B | A(S) | 13 | −0.9 | Comp. |
| 34 | " | " | D(Au) | " | −0.3 | Inv. |
| 35 | F(8.5) | " | A(S) | " | −0.9 | Comp. |
| 36 | " | " | D(Au) | " | −0.3 | Inv. |

Comp. = Comparative Example
Inv. = Invention

With the support comprising two or more layers of the water-proof resin coating having different contents of the white pigment, the sharpness is superior but the pressure induced immunity of the samples having an acidic support is significantly deteriorated after a long-term storage (Sample Nos. 6 through 10, 23, and 24). The pressure induced immunity is also bad for the samples with the sulfur sensitized emulsion even pH of the base paper is adjusted to around neutrality (Sample Nos. 27, 29, 31, 33, and 35). The pressure induced immunity is significantly improved by means of sensitizing the emulsion with selenium, tellurium, or gold and adjusting pH of the base paper to around neutrality, where the sharpness can be achieved with the satisfactory level of the pressure induced immunity (Sample Nos. 17 through 20, 28, 30, 32, 34, and 36).

EXAMPLE 2

The second, third, and fourth photographic structural layers of the samples prepared in Example 1 were changed as set forth in Table 9 below and these samples were assessed in the same manner as in Example 1. As a result, the pressure induced immunity is significantly improved by means of sensitizing the emulsion with selenium, tellurium, or gold and adjusting pH of the base paper to around neutrality, where the sharpness can be achieved with the satisfactory level of the pressure induced immunity as in Example 1.

TABLE 9

| SECOND LAYER (COLOR MIXING INHIBITING LAYER) | |
|---|---|
| Gelatin | 0.99 |
| Color Mixing Inhibitor (Cpd-A) | 0.04 |
| Color Mixing Inhibitor (Cpd-B) | 0.04 |
| Solvent (Solv-10) | 0.16 |
| Solvent (Solv-11) | 0.08 |

TABLE 9-continued

| | |
|---|---|
| Solvent (Solv-12) | 0.03 |
| THIRD LAYER (GREEN-SENSITIVE EMULSION LAYER) | |
| Silver Chlorobromide Emulsion (See Table 8) | 0.12 |
| Magenta Coupler (M-A) | 0.26 |
| Gelatin | 1.24 |
| Color Image Stabilizer (Cpd-16) | 0.03 |
| Color Image Stabilizer (Cpd-17) | 0.04 |
| Color Image Stabilizer (Cpd-18) | 0.02 |
| Color Image Stabilizer (Cpd-19) | 0.02 |
| Solvent (Solv-8) | 0.30 |
| Solvent (Solv-9) | 0.15 |
| FOURTH LAYER (COLOR MIXING INHIBITING LAYER) | |
| Gelatin | 0.70 |
| Color Mixing Inhibitor (Cpd-A) | 0.30 |
| Color Mixing Inhibitor (Cpd-B) | 0.03 |
| Solvent (Solv-10) | 0.11 |
| Solvent (Solv-11) | 0.06 |
| Solvent (Solv-12) | 0.02 |

(Cpd-16) COLOR IMAGE STABILIZER

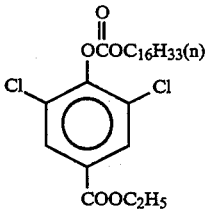

(Cpd-17) COLOR IMAGE STABILIZER

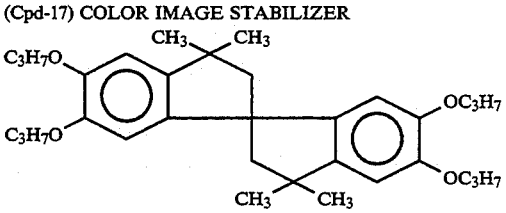

(Cpd-18) COLOR IMAGE STABILIZER
1:1 MIXTURE (MOLAR RATIO) OF:

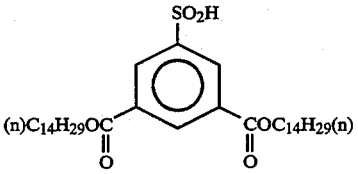

and

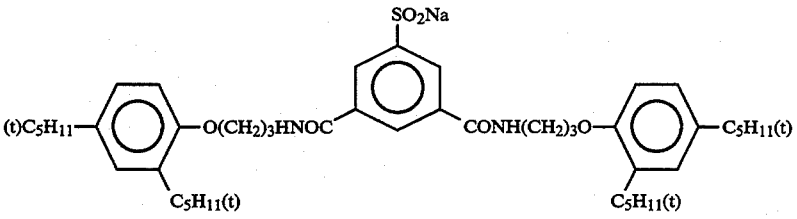

(Cpd-19) COLOR IMAGE STABILIZER

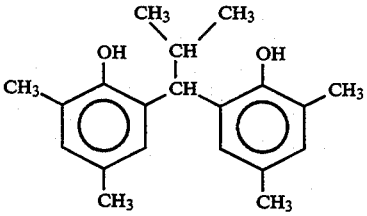

TABLE 9-continued

Cpd-A

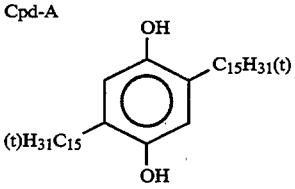

Cpd-B

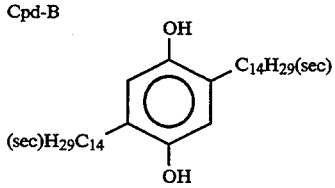

M-A

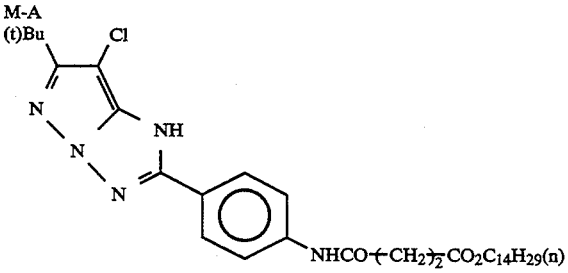

Solv-8

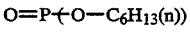

Solv-9

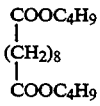

(Solv-10) SOLVENT

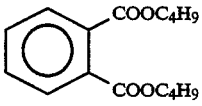

(Solv-11) SOLVENT

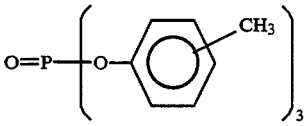

(Solv-12) SOLVENT

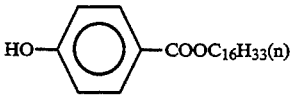

EXAMPLE 3

The photographic structural layers in Example 2 was applied as the coating layer C of the base paper (B) in Example 1 (pH 7.3). In addition, 1-(5-methylureidophenyl)-5-mercaptotetrazole was not added to the green-sensitive emulsion layer and the emulsion as well as the compounds contained in the green-sensitive emulsion layer were changed as shown in Table 10. The pressure induced immunity in this example was measured in the same manner as in Example 1. An amount of the compounds added was $7.7\times10^{-4}$ moles per one mole of silver halide in the green-sensitive emulsion layer. The results are given in Table 10.

TABLE 10

| Sample No. | Emulsion for Green-sensitive Emulsion Layer (Chemical Sensitization) | Compound added to Green-sensitive Emulsion Layer | Pressure Induced Density Change after Aging (ΔD) | Remarks |
|---|---|---|---|---|
| 37 | A(S) | None | −1.2 | Comp. |
| 38 | " | I-16 | −1.1 | " |
| 39 | " | II-12 | −1.1 | " |
| 40 | " | III-26 | −1.1 | " |
| 41 | " | IV-2-6 | −1.1 | " |
| 42 | B(Se) | None | −0.5 | Inv. |
| 43 | " | I-13 | −0.2 | " |
| 44 | " | II-15 | −0.2 | " |
| 45 | " | III-26 | −0.3 | " |
| 46 | " | IV−2−6 | −0.3 | " |
| 47 | E(S/Au) | None | −0.5 | " |
| 48 | " | I-16 | −0.2 | " |
| 49 | " | II-13 | −0.2 | " |
| 50 | " | III-26 | −0.2 | " |
| 51 | " | IV−1−5 | −0.3 | " |
| 52 | " | IV−2−5 | −0.2 | " |
| 53 | " | IV−3−33 | −0.3 | " |

TABLE 10-continued

| Sample No. | Emulsion for Green-sensitive Emulsion Layer (Chemical Sensitization) | Compound added to Green-sensitive Emulsion Layer | Pressure Induced Density Change after Aging (ΔD) | Remarks |
|---|---|---|---|---|
| 54 | " | IV−4−6 | −0.4 | " |

Comp. = Comparative Example
Inv. = Invention

In Table 10, it is found that the pressure induced immunity is remarkably improved in the samples containing the compound represented by the general formula (I), (II), (III), or (IV).

EXAMPLE 4

Images in a color negative film having a transparent magnetic recording layer disclosed in JP-A-4-62543 and U.S. Pat. No. 5,147,768, which is incorporated hereinto by a reference, and images in a typical color negative film having no magnetic recording layer were printed through a printer on the color photographic printing paper obtained in Example 1 according to the present invention and a comparative color photographic printing paper. The effect on the sharpness of the color photographic printing paper was remarkably recognized when the color negative film used had the transparent magnetic recording layer. Accordingly, the present invention is extremely effective to provide a method of forming images of high quality and good in the pressure induced immunity when used in a system combined with color negative films having one or more transparent magnetic recording layers.

EXAMPLE 5

The assessment of Example 1 was repeated on the pressure induced immunity except that the samples prepared in Example 1 were subjected to the following exposure.

(Exposure)

Light beams having wavelengths of 473 nm, and 532 nm were used for exposure. These beams were obtained as follows. YAG solid state laser (oscillation wavelength: 946 nm) was used as a light source, which was excited by semiconductor laser GaAlAs (oscillation wavelength: 808.5 nm) serving as an excitation light source. The YAG solid state laser was introduced into a second harmonic generation (SHG) crystal of $KNbO_3$ for wavelength conversion to produce light of 473 nm in wavelength. $YVO_4$ solid state laser (oscillation wavelength: 1064 nm) was used as a light source, which was excited by a semiconductor laser GaAlAs (oscillation wavelength: 808.7 nm) serving as an excitation light source. The $YVO_4$ solid state laser was introduced into an SHG crystal of KTP for wavelength conversion to produce light of 532 nm in wavelength. In addition, AlGaIP (oscillation wavelength: approximately 670 nm), Type No. TOLD 9211 produced by Toshiba Corporation, was also used. The laser beams were exposed on a color photographic printing paper traveling in the cross direction relative to the scanning direction by using a device capable of successive scanning and exposure. A relation between a density (D) of the photosensitive material and an amount of light (E), i.e., D-logE was obtained by using this device. In this event, the laser beams of three different wavelengths were modulated in amount of light through an external modulator to control the exposure degree. The scanning exposure was performed at 400 dpi and an average exposure time per one pixel was about $5\times10^{-8}$ seconds. A Peltier element was used to maintain the temperature of the semiconductor laser in order to avoid change in amount of light caused by the temperature.

EXAMPLE 6

Continuous processing was performed with processing process and a processing solution which differ in the following manner from those used in Example 1, and the sharpness and the pressure induced immunity were assessed. As a result, similar effects to those in Example 1 were obtained.

| Process | Temperature | Time | Replenishment Rate* | Tank Capacity |
|---|---|---|---|---|
| Color Development | 35° C. | 45 sec. | 161 ml | 17 liters |
| Bleach-fix | 35° C. | 45 sec. | 215 ml | 17 liters |
| Stabilization (1) | 35° C. | 20 sec. | — | 10 liters |
| Stabilization (2) | 35° C. | 20 sec. | — | 10 liters |
| Stabilization (3) | 35° C. | 20 sec. | — | 10 liters |
| Stabilization (4) | 35° C. | 20 sec. | 248 ml | 10 liters |
| Drying | 80° C. | 60 sec. | | |

*Replenishment rate: per square meter of the photosensitive material
*Stabilization steps; 4-tank countercurrent system from (4) to (1)

Formulation of the processing solutions is as follows:

| | Tank Solution | Replenisher |
|---|---|---|
| [Color Developer] | | |
| Water | 800 ml | 800 ml |
| Poly(styrene lithium sulfonate) Solution (30%) | 0.25 ml | 0.25 ml |
| 1-hydroxyethylidene-1,1-diphosphonic acid solution (60%) | 0.8 ml | 0.8 ml |
| Lithium Sulfate (anhydride) | 2.7 g | 2.7 g |
| Triethanolamine | 8.0 g | 8.0 g |
| Potassium Chloride | 1.8 g | — |
| Potassium Bromide | 0.03 g | 0.025 g |
| Diethylhydroxylamine | 4.6 g | 7.2 g |
| Glycine | 5.2 g | 8.1 g |
| Threonine | 4.1 g | 6.4 g |
| Potassium Carbonate | 27 g | 27 g |
| Potassium Sulfite | 0.1 g | 0.2 g |
| N-ethyl-N-(β-methanesulfonamideethyl)-3-methyl-4-aminoaniline. 3/2 sulfuric acid.1 water salt | 4.5 g | 7.3 g |
| Fluorescent Whitening Agent (4,4',-diaminostilbene) | 2.0 g | 3.0 g |
| Total (with added water) | 1000 ml | 1000 ml |
| pH (25° C.) (adjusted with potassium hydroxide and sulfuric acid) | 10.12 | 10.70 |
| [Bleach-fixing Solution] (tank solution and replenisher are same) | | |
| Water | | 400 ml |
| Ammonium Thiosulfate (700 g/liter) | | 100 ml |
| Sodium Sulfite | | 17 g |
| Ethylenediaminetetraacetato Ferrite (III) Ammonium | | 55 g |
| Ferrous Disodium Ethylenediamine Tetraacetate | | 5 g |
| Glacial Acetic Acid | | 9 g |
| Total (with added water) | | 1000 ml |
| pH (25° C.) (adjusted with acetic acid and ammonium) | | 5.40 |
| [Stabilizer] (tank solution and replenisher are same) | | |
| 1,2-Benzisothiazolin-3-one | | 0.02 g |
| Polyvinylpyrrolidone | | 0.05 g |
| Total (with added water) | | 1000 ml |
| pH (25° C.) | | 7.00 |

According to the present invention, it is possible to provide a silver halide color photographic photosensitive material which is superior in image sharpness, is less deteriorated in performance in a long-term storage thereof, and is capable of forming images of high-quality as well as to provide a method of forming color images using this photosensitive material.

What is claimed is:

1. A silver halide color photographic photosensitive material comprising a reflective support having thereon at least one photosensitive silver halide emulsion layer, wherein said reflective support comprises a base paper and two or more water-proof resin layers laminated on one surface of the base paper at the side to be coated with the photosensitive emulsion, the water-proof resin layers having different contents of a white pigment, the base paper having pH of from 5 to 9, and wherein said silver halide emulsion layer contains silver halide emulsion having a silver chloride content of 95% by mole or higher and being sensitized with selenium, tellurium, or gold.

2. A silver halide color photographic photosensitive material as claimed in claim 1, wherein a content of the white pigment in a water-proof resin layer that is closest to the base paper is lower than that in at least one of the other water-proof resin layers.

3. A silver halide color photographic photosensitive material as claimed in claim 2, wherein the water-proof resin layer that is closest to the photosensitive silver halide emulsion layer has the highest content of the white pigment of the water-proof resin layers.

4. A silver halide color photographic photosensitive material as claimed in claim 2, wherein the water-proof resin layers comprise at least three layers having different contents of the white pigment, of which an interlayer has the highest content of the white pigment, the interlayer being located between the water-proof resin layer that is closest to the photosensitive silver halide emulsion layer and the water-proof resin layer that is closest to the base paper.

5. A silver halide color photographic photosensitive material as claimed in claim 1, wherein the white pigment contained in the water-proof resin layers is titanium dioxide, and wherein a content of the titanium dioxide in the water-proof resin layer having the highest content of the white pigment is 15% by weight or higher.

6. A silver halide color photographic photosensitive material as claimed in claim 1, wherein one or more compounds represented by the following general formula (I), (II), and (III) are contained in the silver halide emulsion layer having a silver chloride content of 95% by mole or higher, the silver chloride being sensitized with selenium, tellurium, or gold:

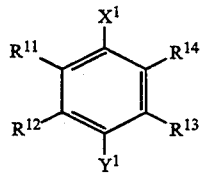

(I)

wherein $X^1$ and $Y^1$ each represents a hydroxyl group, $—NR^{15}R^{16}$, or $—NHSO_2R^{17}$; $R^{11}$, $R^{12}$, $R^{13}$, and $R^{14}$ each represents a hydrogen atom or a substituent, or at least one of $R^{11}$–$R^{12}$ and $R^{13}$–$R^{14}$ each represents atomic groups necessary to form a carbon ring in cooperation with each other; $R^{15}$ and $R^{16}$ each represents a hydrogen atom, an alkyl group, an aryl group, or a heterocyclic group, or $R^{15}$ and $R^{16}$ represent atomic groups necessary to form a heterocyclic group containing a nitrogen atom in cooperation with each other; and $R^{17}$ represents an alkyl group, an aryl group, an amino group, or a heterocyclic group;

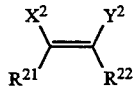

(II)

wherein $X^2$ and $Y^2$ each represents a hydroxyl group, $—NR^{23}R^{24}$, or $—NHSO_2R^{25}$; $R^{21}$ and $R^{22}$ each represents a hydrogen atom or a substituent, or $R^{21}$ and $R^{22}$ represent atomic groups necessary to form a carbon ring or a heterocyclic ring in cooperation with each other; $R^{23}$ and $R^{24}$ each represents a hydrogen atom, an alkyl group, an aryl group, or a heterocyclic group, or $R^{23}$ and $R^{24}$ represent atomic groups necessary to form a heterocyclic ring containing a nitrogen atom in cooperation with each other; and $R^{25}$ represents an alkyl group, an aryl group, an amino group, or a heterocyclic group; and $$R^{31}\text{—}(Y^3)_n\text{—}NH\text{—}X^3 \qquad \text{(III)}$$

wherein $X^3$ represents a hydroxyl group or $—NR^{32}R^{33}$; $Y^3$ represents —CO— or $—SO_2—$; $R^{31}$ represents a hydrogen atom or a substituent; n represents 0 or 1; and $R^{32}$ and $R^{33}$ each represents a hydrogen atom, an alkyl group, an aryl group, or a heterocyclic group, or at least one of $R^{31}$–$R^{32}$ and $R^{32}$–$R^{33}$ each represents atomic groups necessary to form a heterocyclic ring in cooperation with each other.

7. A silver halide color photographic photosensitive material as claimed in claim 1, wherein one or more heterocyclic mercapto compounds are contained in the silver halide emulsion layer sensitized with selenium, tellurium, or gold and having a silver chloride content of 95% by mole or higher.

8. A silver halide color photographic photosensitive material as claimed in claim 5, wherein a content of the white pigment in the water-proof resin layer(s) containing the white pigment is at most 40% by weight.

9. A silver halide color photographic photosensitive material as claimed in claim 8, wherein a content of the white pigment in the water-proof resin layer having the highest content thereof ranges from 20% to 40% by weight.

10. A silver halide color photographic photosensitive material as claimed in claim 1, wherein a water-proof resin of the water-proof resin layer is polyethylene.

11. A silver halide color photographic photosensitive material as claimed in claim 1, wherein pH of the base paper for the reflective support ranges from 5.5 to 8.5.

12. A silver halide color photographic photosensitive material as claimed in claim 1, wherein a total thickness of the water-proof resin layers ranges from 5 to 80 μm.

13. A silver halide color photographic photosensitive material as claimed in claim 7, wherein the heterocyclic mercapto compound is represented by the formula (IV):

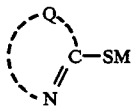

(IV)

wherein Q represents atomic groups required for forming a five- or six-membered heterocyclic ring or five- or six-membered heterocyclic ring to which a benzene ring is condensed, and M represents a cation.

14. A silver halide color photographic photosensitive material as claimed in claim 13, wherein the heterocyclic mercapto compound is represented by the formula (IV-1):

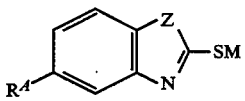

(IV-1)

wherein $R^4$ represents a hydrogen atom, an alkyl group, an alkoxy group, an aryl group, a halogen atom, a carboxyl group or a salt thereof, a sulfo group or a salt thereof, or an amino group; Z represents —NH—, —O— or —S—; and M is a cation.

15. A silver halide color photographic photosensitive material as claimed in claim 13, wherein the heterocyclic mercapto compound is represented by the formula (IV-2):

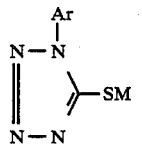

(IV-2)

wherein Ar represents

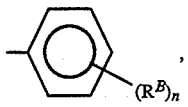

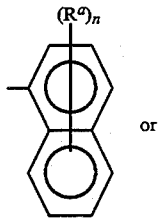

or

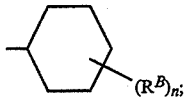

$R^B$ represents an alkyl group, an alkoxy group, a carboxyl group or a salt thereof, a sulfo group or a salt thereof, a hydroxyl group, an amino group, an acylamino group, a carbamoyl group or a sulfamide; n represents an integer of from 0 to 2; and M is a cation.

16. A silver halide color photographic photosensitive material as claimed in claim 13, wherein the heterocyclic mercapto compound is represented by the formula (IV-3):

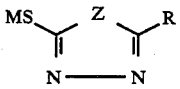

(IV-3)

wherein Z represents —N($R^{A1}$)—, an oxygen atom or a sulfur atom; R represents a hydrogen atom, an alkyl group, an aryl group, an alkenyl group, a cycloalkyl group, —$SR^{A1}$—, —N($R^{A2}$)$R^{A3}$—, —$NHCOR^{A4}$—, —$NHSO_2$, $R^{A5}$ or a heterocyclic group; $R^{A1}$ represents a hydrogen atom, an alkyl group, an alkenyl group, a cycloalkyl group, an aryl group, —$COR^{A4}$ or —$SO_2$-$R^{A5}$; $R^{A2}$ and $R^{A3}$ each represents a hydrogen atom, an alkyl group or an aryl group; and $R^{A4}$ and $R^{A5}$ each represents an alkyl group or an aryl group; M is a cation.

17. A silver halide color photographic photosensitive material as claimed in claim 13, wherein the heterocyclic mercapto compound is represented by the formula (IV-4):

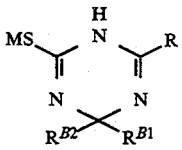

(IV-4)

wherein R and M are same as R and M in the general formula (IV-3), respectively; $R^{B1}$ and $R^{B2}$ are same as $R^{A1}$ and $R^{A2}$ in the general formula (IV-3), respectively.

* * * * *